US008149171B2

(12) United States Patent
Baliarda et al.

(10) Patent No.: US 8,149,171 B2
(45) Date of Patent: Apr. 3, 2012

(54) MINIATURE ANTENNA HAVING A VOLUMETRIC STRUCTURE

(75) Inventors: Carles Puente Baliarda, Barcelona (ES); Jordi Soler-Castany, Barcelona (ES); Juan Ignacio Ortigosa-Vallejo, Barcelona (ES); Jaume Anguera-Pros, Castellon (ES)

(73) Assignee: Fractus, S.A., Barcelona (ES)

( * ) Notice: Subject to any disclaimer, the term of this patent is extended or adjusted under 35 U.S.C. 154(b) by 35 days.

(21) Appl. No.: 12/364,066

(22) Filed: Feb. 2, 2009

(65) Prior Publication Data

US 2009/0167612 A1 Jul. 2, 2009

Related U.S. Application Data

(63) Continuation of application No. 11/202,881, filed on Aug. 12, 2005, now Pat. No. 7,504,997, which is a continuation of application No. PCT/EP03/01695, filed on Feb. 19, 2003.

(51) Int. Cl.
*H01Q 1/38* (2006.01)

(52) U.S. Cl. ..... 343/700 MS

(58) Field of Classification Search ..... 343/700 MS, 343/702, 797, 853

See application file for complete search history.

(56) References Cited

U.S. PATENT DOCUMENTS

| | | | |
|---|---|---|---|
| 4,072,951 | A | 2/1978 | Kaloi |
| 4,381,566 | A | 4/1983 | Kane et al. |
| 4,578,654 | A | 3/1986 | Tait |
| 4,723,305 | A | 2/1988 | Phillips et al. |
| 4,894,663 | A | 1/1990 | Urbish et al. |
| 5,214,434 | A | 5/1993 | Hsu et al. |
| 5,218,370 | A | 6/1993 | Blaese |
| 5,309,165 | A | 5/1994 | Segal et al. |
| 5,365,246 | A | 11/1994 | Rasinger et al. |
| 5,644,319 | A | 7/1997 | Chen et al. |
| 5,684,672 | A | 11/1997 | Karidis et al. |
| 5,786,792 | A | 7/1998 | Bellus et al. |
| 5,841,403 | A | 11/1998 | West |
| 5,870,066 | A | 2/1999 | Asakura et al. |
| 5,943,020 | A | 8/1999 | Liebendoerfer et al. |

(Continued)

FOREIGN PATENT DOCUMENTS

| | | |
|---|---|---|
| EP | 0 688 040 | 12/1995 |

(Continued)

OTHER PUBLICATIONS

Baliarada, Carles Puente, "Fractal Antennas", Diddertation, Electromagnetics and Photoics Engineering group, UPC, May 1997.

(Continued)

*Primary Examiner* — Huedung Mancuso
(74) *Attorney, Agent, or Firm* — Winstead PC

(57) ABSTRACT

A miniature antenna includes a radiating arm that defines a grid dimension curve. In one embodiment, the radiating arm includes a planar portion and at least one extruded portion. The planar portion of the radiating arm defines the grid dimension curve. The extruded portion of the radiating arm extends from the planar portion of the radiating arm to define a three-dimensional structure. In one embodiment, the miniature antenna includes a first radiating arm that defines a first grid dimension curve within a first plane and a second radiating arm that defines a second grid dimension curve within a second plane. In one embodiment, the miniature antenna includes a radiating arm that forms a non-planar structure.

39 Claims, 31 Drawing Sheets

U.S. PATENT DOCUMENTS

| | | | | |
|---|---|---|---|---|
| 5,986,609 | A | 11/1999 | Spall | |
| 6,008,775 | A | 12/1999 | Bobowicz | |
| 6,075,500 | A | 6/2000 | Kurz et al. | |
| 6,094,179 | A | 7/2000 | Davidson | |
| 6,140,975 | A | 10/2000 | Cohen | |
| 6,211,889 | B1 | 4/2001 | Stoutamire | |
| 6,300,914 | B1 | 10/2001 | Yang | |
| 6,329,951 | B1 | 12/2001 | Wen et al. | |
| 6,343,208 | B1 | 1/2002 | Ying et al. | |
| 6,408,190 | B1 | 6/2002 | Ying et al. | |
| 6,433,742 | B1 | 8/2002 | Crawford | |
| 6,445,352 | B1 | 9/2002 | Cohen | |
| 6,452,553 | B1 | 9/2002 | Cohen | |
| 6,466,170 | B2 | 10/2002 | Zhou | |
| 6,498,586 | B2 | 12/2002 | Pankinaho et al. | |
| 6,535,175 | B2 | 3/2003 | Brady et al. | |
| 6,552,690 | B2 | 4/2003 | Veerasamy | |
| 6,603,440 | B2 | 8/2003 | Howard | |
| 6,611,237 | B2 | 8/2003 | Smith | |
| 6,614,400 | B2 | 9/2003 | Egorov et al. | |
| 6,642,898 | B2 | 11/2003 | Eason | |
| 6,670,932 | B1 | 12/2003 | Diaz et al. | |
| 6,697,023 | B1 | 2/2004 | Tiao-Hsing et al. | |
| 6,710,744 | B2 | 3/2004 | Morris et al. | |
| 6,762,719 | B2 | 7/2004 | Subotic et al. | |
| 6,822,617 | B1 | 11/2004 | Mather et al. | |
| 6,876,320 | B2 | 4/2005 | Puente Baliarda et al. | |
| 6,900,773 | B2 | 5/2005 | Poilasne | |
| 7,015,868 | B2 | 3/2006 | Puente Baliarde et al. | |
| 7,504,997 | B2 * | 3/2009 | Baliarda et al. | 343/702 |
| 2003/0001794 | A1 | 1/2003 | Park et al. | |
| 2003/0090421 | A1 | 5/2003 | Sajadinia | |
| 2003/0098814 | A1 | 5/2003 | Keller et al. | |
| 2003/0142036 | A1 | 7/2003 | Wilhelm et al. | |
| 2003/0174092 | A1 | 9/2003 | Sullivan et al. | |
| 2004/0014428 | A1 | 1/2004 | Franca-Neto | |
| 2004/0056804 | A1 | 3/2004 | Kadambi et al. | |
| 2004/0095281 | A1 | 5/2004 | Poilasne et al. | |
| 2004/0119644 | A1 | 6/2004 | Puente-Baliarda et al. | |
| 2005/0237238 | A1 | 10/2005 | Rahola | |
| 2006/0256018 | A1 * | 11/2006 | Soler Castany et al. | 343/770 |
| 2009/0262028 | A1 * | 10/2009 | Mumbru et al. | 343/702 |
| 2010/0171675 | A1 * | 7/2010 | Borja et al. | 343/798 |

FOREIGN PATENT DOCUMENTS

| | | | |
|---|---|---|---|
| EP | 0 814 536 | | 12/1997 |
| EP | 0 929 121 | | 7/1999 |
| EP | 0 932 219 | | 7/1999 |
| JP | 2003-032022 | | 1/2003 |
| JP | 2003032022 | | 1/2003 |
| SE | 518988 | | 12/2002 |
| WO | WO-93/12559 | | 6/1993 |
| WO | WO-9312559 | | 6/1993 |
| WO | WO-96/27219 | | 9/1996 |
| WO | WO-00/52787 | | 9/2000 |
| WO | WO-0108257 | | 2/2001 |
| WO | 01/39321 | A1 | 5/2001 |
| WO | WO-01/54225 | | 7/2001 |
| WO | WO-0189031 | | 11/2001 |
| WO | WO-0235646 | | 5/2002 |
| WO | WO-02/0632714 | | 8/2002 |
| WO | WO-02/078124 | | 10/2002 |
| WO | WO-02078121 | | 10/2002 |
| WO | WO-02/096166 | | 11/2002 |
| WO | WO-03041219 | | 5/2003 |
| WO | WO-03050915 | | 6/2003 |
| WO | WO-2004025778 | | 3/2004 |
| WO | WO-2004/042868 | | 5/2004 |
| WO | WO-2004042868 | | 5/2004 |
| WO | 2004047222 | A1 | 6/2004 |

OTHER PUBLICATIONS

Hansen, R. C., "Fundamenal Limitations in Atennas", IEEE, Proceedings of the IEEE, vol. 69, No. 2, Feb. 1981, pp. 170-182.

Cohen, Nathan; "Fractal Antennas—Part 1—Introduction and the Fractal Quad", Communication Quarterly, Summer 1995, p. 7-22.

Jaggard, Dwight L., "Fractal Electrodynamics and Modeling", Directions in Electromagnetic Wave Modeling, 1991, pp. 435-446.

Hohlfeld, Robert G. et al., "Self-Similarity and the Geometric Requirements for Frequency Independence in Antennae", Fractals, Worl Scientific Publishing Company, vol. 7, No. 1, 1999, pp. 79-84.

Romeu, Jordi et al; "A Three Dimensional Hilbert Antenna", IEEE, 2002, pp. 550-553.

Puente, C. et al., "Multiband Fractal Antennas and Arrays", Electromagnetics and Photonics Enginerring group, pp. 223-236.

Escala, Oscar Campos, "Projecte Final De Carrera—Estudi D'Antenes Fractals Multibanda I En Miniatura".

Gianvittorio, John P. et al., "Fractal Element Antennas: A Compilation of Configureations with Novel Characteristics", IEEE, 2000, 4 pages.

Mayes, Paul E., "Frequency-Independent Antennas and Broad-Band Derivatives Thereof", Proceedings of the IEEE, vol. 80, No. 1, Jan. 1992, pp. 103-112.

English Language Translation of JP-2003-032022 as published Jan. 31, 2003 ,(11 pages).

Colburn , J. S. et al, Human proximity effects on circular polarized handset antennas in personal satellite, IEEE Transactions on Antennas and Propagation, Jun. 6, 1996.

Falconer, K., Fractal geometry: Mathematical foundations and applications, Wiley, 2003.

Zhu et al. Bandwidth, cross-polarization, and feed-point characteristics of matched hilbert antennas, IEEE Antennas and Wireless Propagation Letters, 2003, vol. 2.

Strugatsky, Multimode multiband antenna, Proceedings of the tactical communications conference, 1992.

Robin et al., Electromagnetic properties of fractal aggregates, Europhysics Letters, Jan. 1993, pp. 273-278, vol. 21, No. 3.

Zygiridis et al., Sierpinski double-gasket antenna investigated with 3-D FDTD conformal technique, Electronic Letters, Jan. 2002, pp. 107-109, vol. 38, No. 3.

Lee et al. Very-low-profile bent planar monopole antenna for GSM/DCS dual-band mobile phone, Microwave and Optical Technology Letters, Sep. 2002, pp. 406-409, vol. 34, No. 6.

Wong, Compact and broadband microstrip antennas, 2002.

Skrivervik , A. K., et al, PCS antenna design—The challenge of miniaturization, IEEE Antennas and propagation magazine, Aug. 2001.

Offutt , W. ; DeSize , L. K. Antenna Egineering Handbook—Chapter 23—Methods of Polarization Synthesis Johnson R. C.—McGraw Hill. 1993.

Jaggard , D. L. Expert report of Dwight L. Jaggard (redacted)—expert witness retained by Fractus. Feb. 2011.

Rumsey , V. Frequency independent antennas—Full Academic Press. 1966.

Schaubert , D. H. ; Chang , W. C. ; Wunsch , G. J. Measurement of phased array performance at arbitrary scan angles Antenna Applications Symposium. Sep. 21, 1994.

Mancuso , H. Notice of Allowance of U.S. Appl. No. 11/202,881 dated on May 11, 2008. USPTO.

Mancuso , H. Office Action of U.S. Appl. No. 11/202,881 dated on Dec. 31, 2007. USPTO.

Jaggard , D. L. Rebuttal expert report of Dr. Dwight L. Jaggard (redacted version) Fractus. Feb. 16, 2011.

Robinson , R. Response to the Office Action dated Dec. 31, 2007 of U.S. Appl. No. 11/202,881 Winstead. May 2008.

Parron , J. ; Rius , J. ; Romeu , J. Study of the Koch fractal monopole in the frequency domain. Fractalcoms. May 2002.

Kaiser , P. The inclined log-spiral antenna, a new type of unidirectional, frequency independent antenna Antennas and Propagation, IEEE Transactions on. Mar. 1967.

* cited by examiner

MINIATURE ANTENNA HAVING A VOLUMETRIC STRUCTURE

CROSS-REFERENCE TO RELATED APPLICATIONS

This patent application is a continuation of U.S. patent application Ser. No. 11/202,881, filed on Aug. 12, 2005 now U.S. Pat. No. 7,504,997. U.S. patent application Ser. No. 11/202,881 is a continuation of PCT/EP2003/001695, filed on Feb. 19, 2003. U.S. patent application Ser. No. 11/202,881 and International Application No. PCT/EP2003/001695 are incorporated herein by reference.

FIELD

The technology described in this patent application relates generally to the field of antennas. More particularly, the application describes a miniature antenna having a volumetric structure. The technology described in this patent is especially well suited for long wavelength applications, such as high power radio broadcast antennas, long distance high-frequency (HF) communication antennas, medium frequency (MF) communication antennas, low-frequency (LF) communication antennas, very low-frequency (VLF) communication antennas, VHF antennas, and UHF antennas, but may also have utility in other antenna applications.

BACKGROUND

Miniature antenna structures are known in this field. For example, a miniature antenna structure utilizing a geometry referred to as a space-filling curve is described in the co-owned International PCT Application WO 01/54225, entitled "Space-Filling Miniature Antennas," which is hereby incorporated into the present application by reference. FIG. 1 shows one example of a space-filling curve 10. A space-filling curve 10 is formed from a line that includes at least ten segments, with each segment forming an angle with an adjacent segment. In addition, when used in an antenna, each segment in the space-filling curve 10 should be shorter than one-tenth of the free-space operating wavelength of the antenna.

It should be understood that a miniature antenna as used within this application refers to an antenna structure with physical dimensions that are small relative to the operational wavelength of the antenna. The actual physical dimensions of the miniature antenna will, therefore, vary depending upon the particular application. For instance, one exemplary application for a miniature antenna is a long wavelength HF communication antenna. Such antennas are often located onboard ships for which a small dimensioned antenna structure may be desirable. A typical long wavelength HF antenna onboard a ship that operates in the 2-30 MHz range may, for example, be ten (10) to fifty (50) meters in height, and can be significantly reduced in size using a miniature antenna structure, as described herein. In comparison, if a miniature antenna structure, as describe herein, is used as the antenna in a cellular telephone, then the overall physical dimensions of the miniature antenna will be significantly smaller.

SUMMARY

A miniature antenna includes a radiating arm that defines a grid dimension curve. In one embodiment, the radiating arm includes a planar portion and at least one extruded portion. The planar portion of the radiating arm defines the grid dimension curve. The extruded portion of the radiating arm extends from the planar portion of the radiating arm to define a three-dimensional structure. In one embodiment, the miniature antenna includes a first radiating arm that defines a first grid dimension curve within a first plane and a second radiating arm that defines a second grid dimension curve within a second plane. In one embodiment, the miniature antenna includes a radiating arm that forms a non-planar structure.

DETAILED DESCRIPTION

Referring now to the remaining drawing figures, FIGS. 2-5 illustrate an exemplary two-dimensional antenna geometry 20 forming a grid dimension curve. The grid dimension of a curve may be calculated as follows. A first grid having square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid should include at least twenty-five cells, and the second grid should include four times the number of cells as the first grid. Thus, the length (L2) of each square cell in the second grid should be one-half the length (L1) of each square cell in the first grid. The grid dimension ($D_g$) may then be calculated with the following equation:

$$D_g = -\frac{\log(N2) - \log(N1)}{\log(L2) - \log(L1)}.$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

Figure 1:
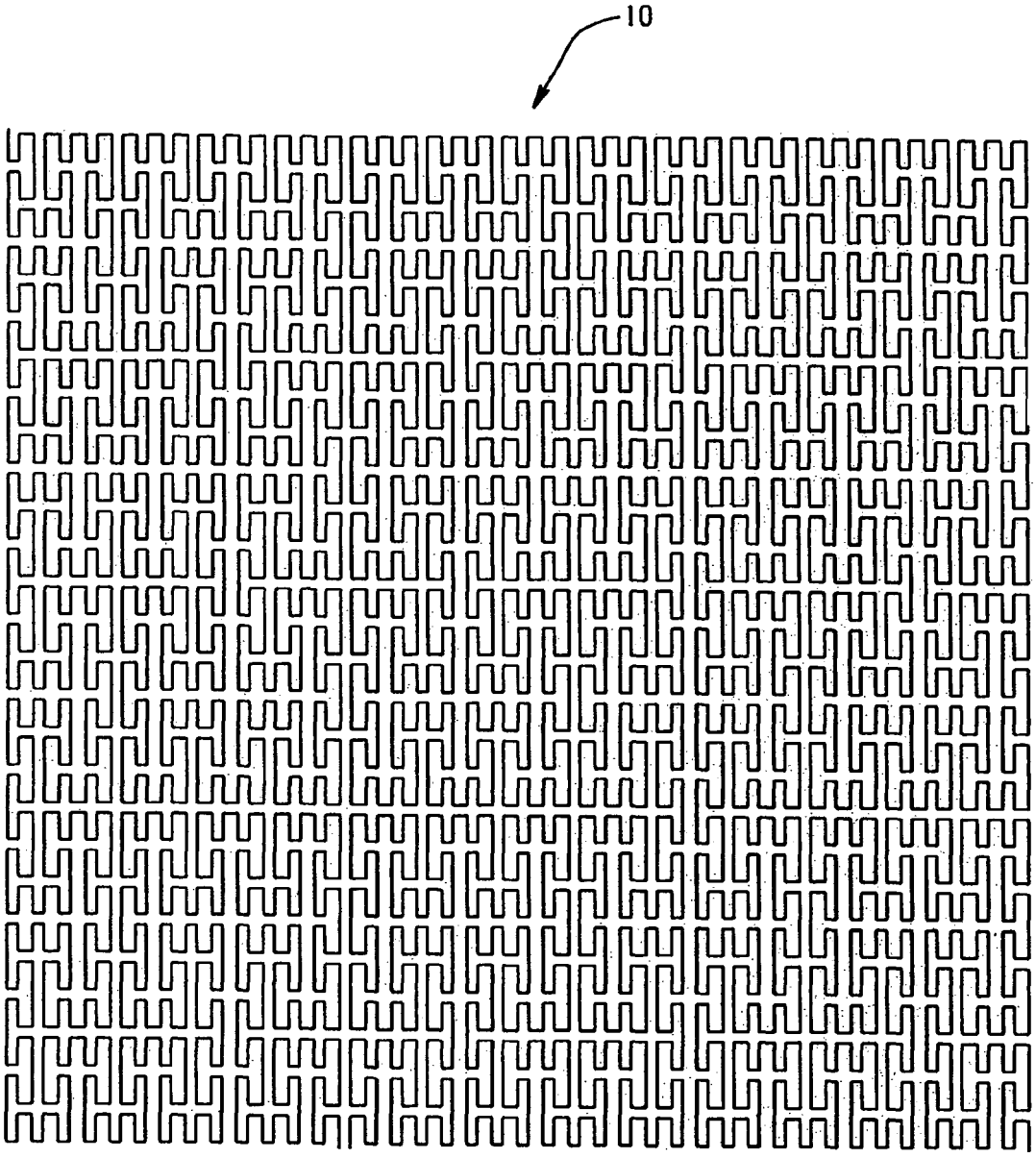
Fig. 1 PRIOR ART
FIG. 1 shows one example of a space-filling curve.
Figure 2:
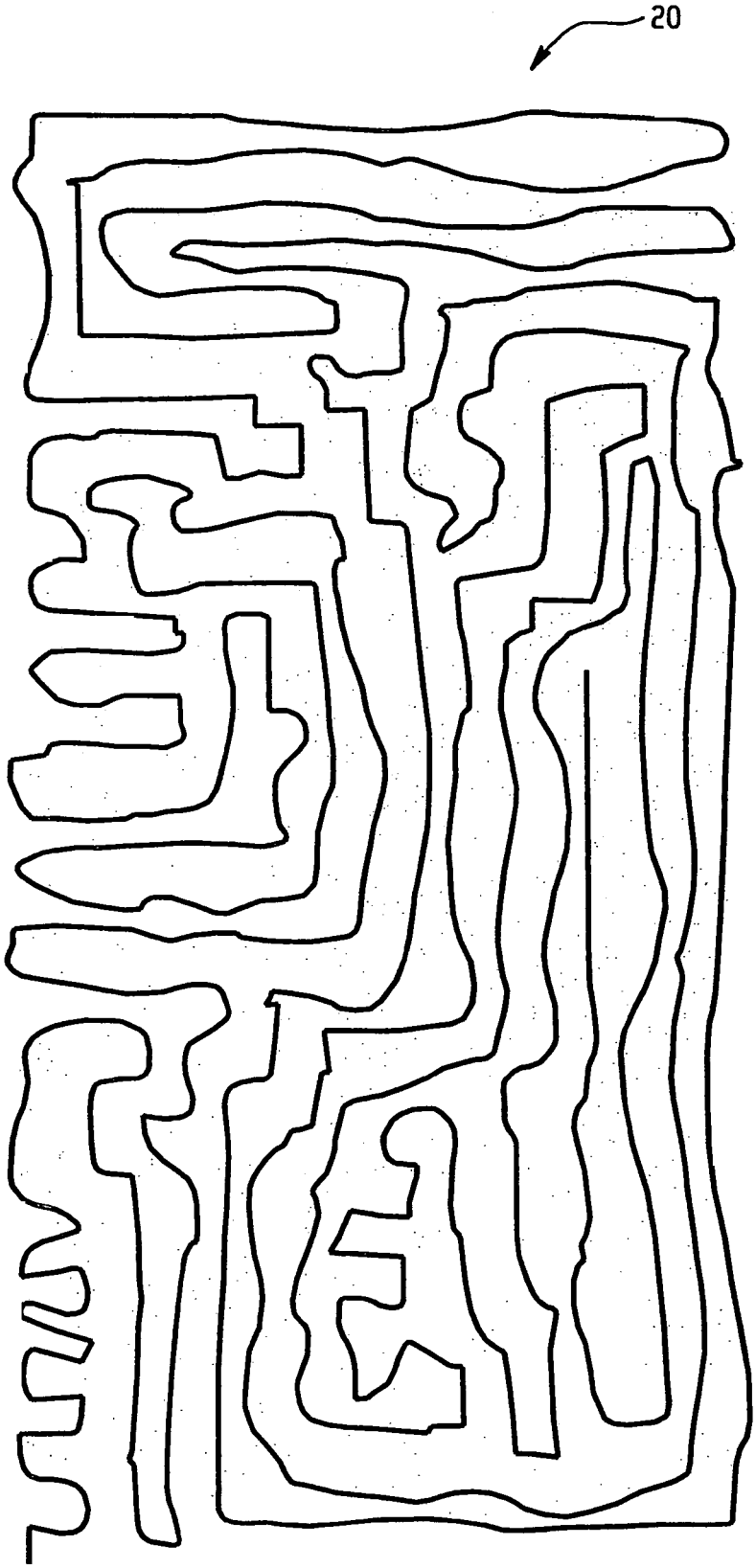
FIGS. 2-5 illustrate an exemplary two-dimensional antenna geometry forming a grid dimension curve.
Figure 3:
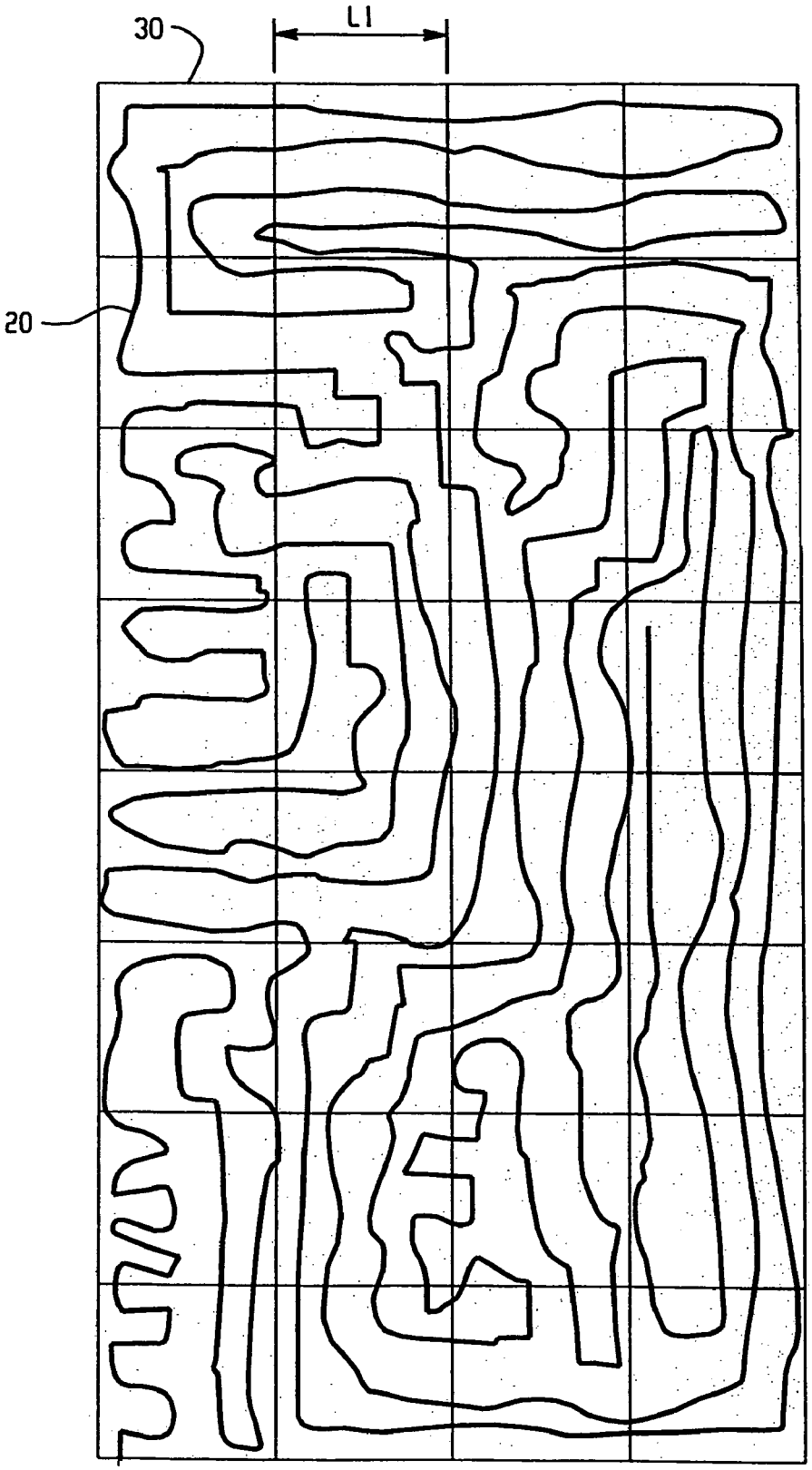
Figure 4:
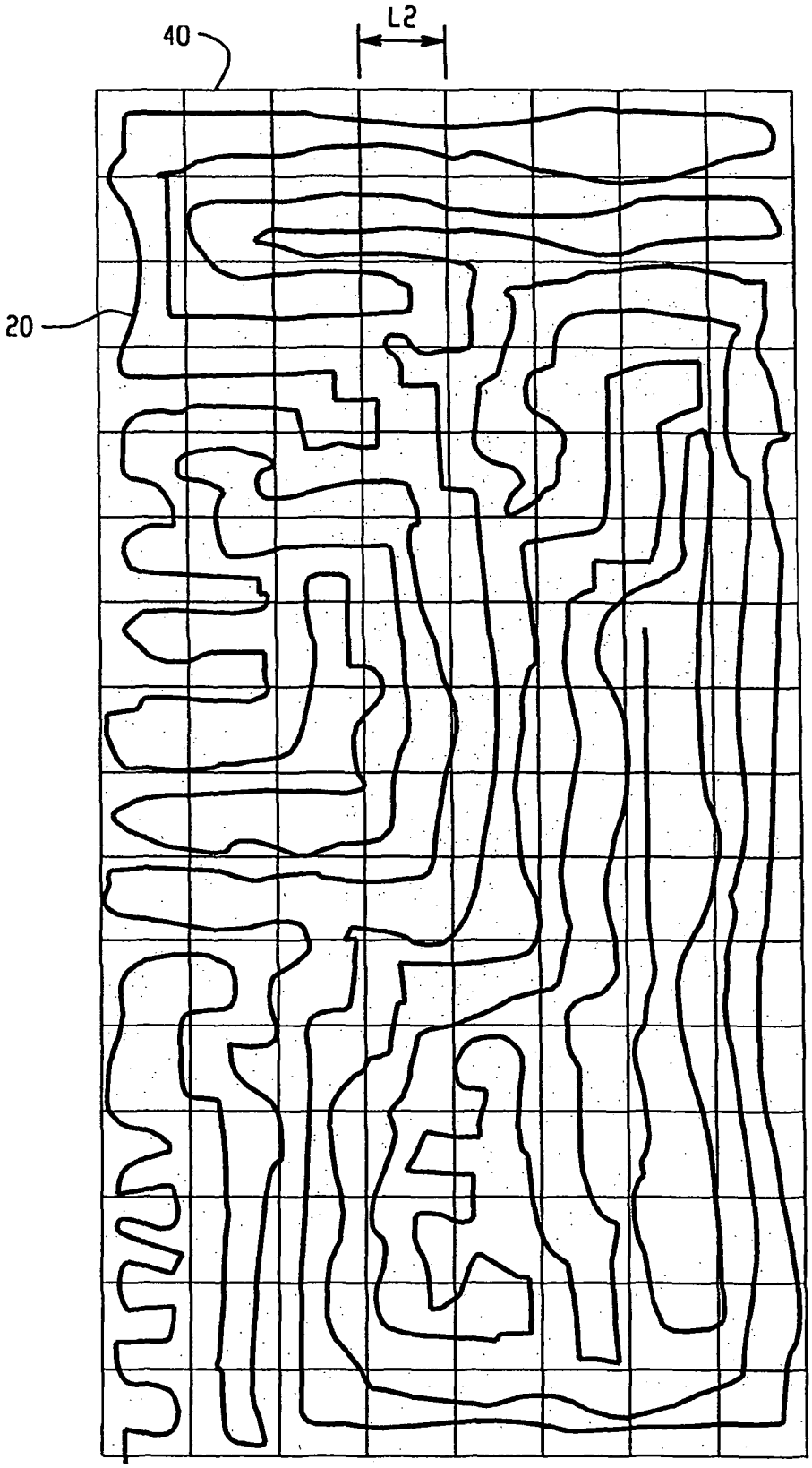

FIG. 2 shows an exemplary two-dimensional antenna 20 forming a grid dimension curve with a grid dimension of approximately two (2). FIG. 3 shows the antenna 20 of FIG. 2 enclosed in a first grid 30 having thirty-two (32) square cells, each with a length L1. FIG. 4 shows the same antenna 20 enclosed in a second grid 40 having one hundred twenty-eight (128) square cells, each with a length L2. The length (L1) of each square cell in the first grid 30 is twice the length (L2) of each square cell in the second grid 40 (L2=2×L1). An examination of FIGS. 3 and 4 reveal that at least a portion of the antenna 20 is enclosed within every square cell in both the first and second grids 30, 40. Therefore, the value of N1 in the above grid dimension ($D_g$) equation is thirty-two (32) (i.e., the total number of cells in the first grid 30), and the value of N2 is one hundred twenty-eight (128) (i.e., the total number of cells in the second grid 40). Using the above equation, the grid dimension of the antenna 20 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependant upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 5:
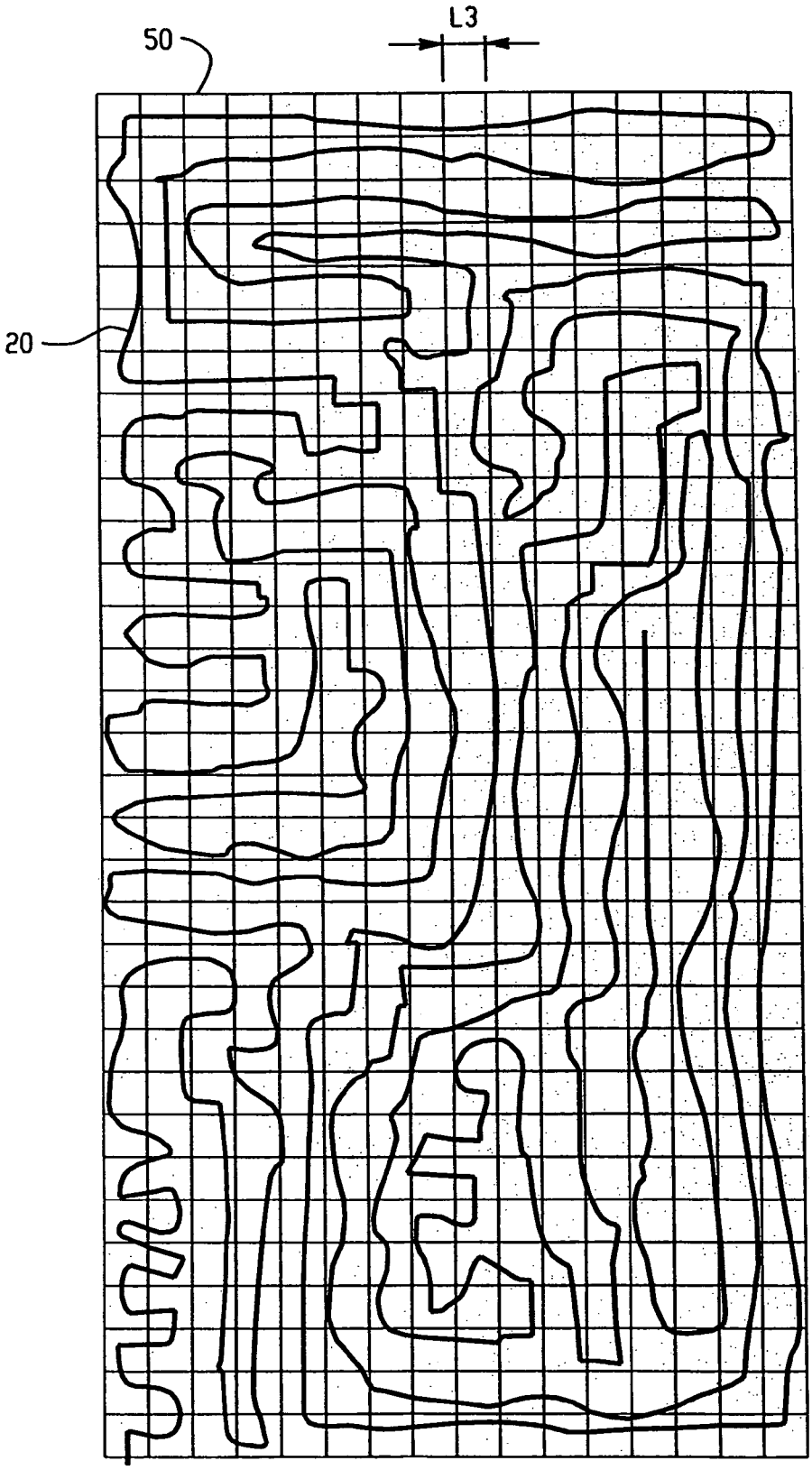

For example, FIG. 5 shows the same antenna 20 enclosed in a third grid 50 with five hundred twelve (512) square cells, each having a length L3. The length (L3) of the cells in the third grid 50 is one half the length (L2) of the cells in the second grid 40, shown in FIG. 4. As noted above, a portion of the antenna 20 is enclosed within every square cell in the second grid 40, thus the value of N for the second grid 40 is one hundred twenty-eight (128). An examination of FIG. 5, however, reveals that the antenna 20 is enclosed within only five hundred nine (509) of the five hundred twelve (512) cells of the third grid 50. Therefore, the value of N for the third grid 50 is five hundred nine (509). Using FIGS. 4 and 5, a more accurate value for the grid dimension (D) of the antenna 20 may be calculated as follows:

$$D_g = -\frac{\log(509) - \log(128)}{\log(2 \times L2) - \log(L2)} \approx 1.9915$$

Figure 6:
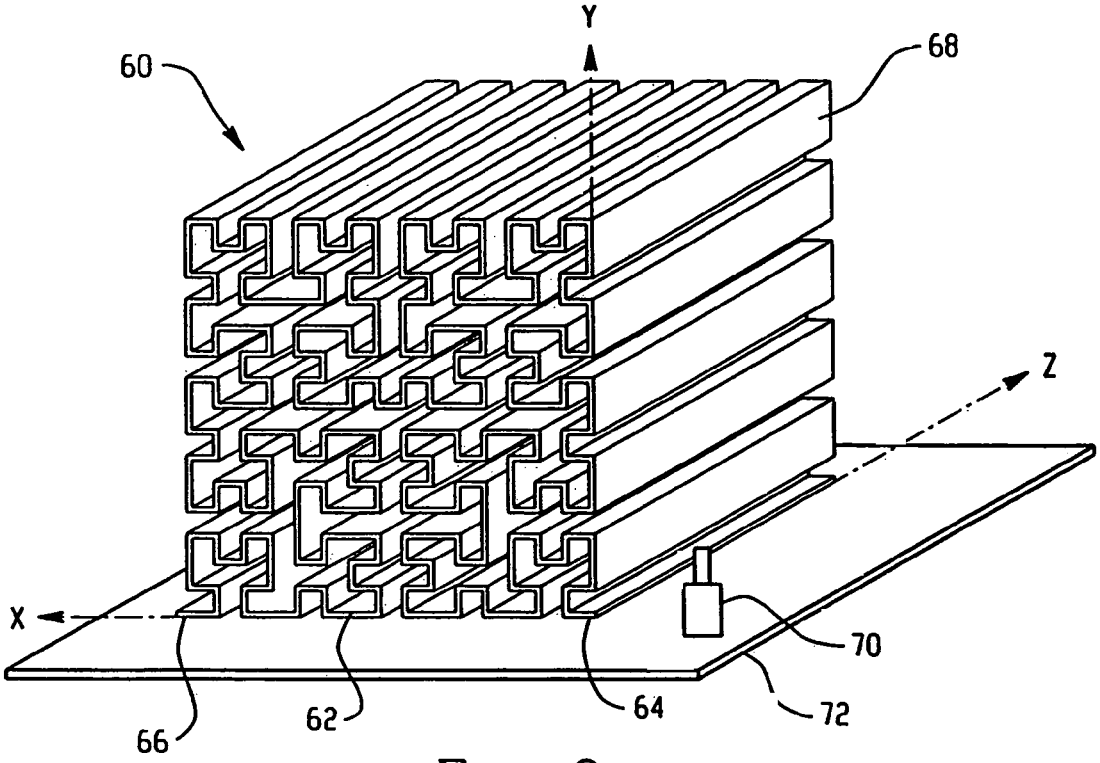
FIG. 6 shows a three-dimensional view of an exemplary miniature antenna having an extruded volumetric structure.

FIG. 6 shows a three-dimensional view of an exemplary miniature antenna 60 having an extruded volumetric structure. Also shown are x, y and z axes to help illustrate the orientation of the antenna 60. The antenna 60 includes a radiating arm that defines a grid dimension curve 62 in the xy plane. More particularly, the grid dimension curve 62 extends continuously in the xy plane between a first end point 64 and a second end point 66, and forms a rectangular periphery in the xy plane. In addition, the antenna 60 includes an extruded portion 68 that extends away from the grid dimension curve 62 in a direction parallel to the z axis, forming a three-dimensional representation of the grid dimension curve 62. A feeding point 70 is located at a point on the extruded portion 68 along the z axis from the first end point 64 of the grid dimension curve 62. Also illustrated is a ground plane 72 in the xz plane that is separated from the antenna 60 by a pre-defined distance. The antenna 60 could, for example, be separated from the ground plane 72 by some type of dielectric material, as known to those skilled in the art.

In operation, the feeding point 70 of the antenna 60 is coupled to circuitry to send and/or receive RF signals within a pre-selected frequency band. The frequency band of the antenna 60 may be tuned, for example, by changing the overall length of the grid dimension curve 62. The location of the feeding point 70 on the antenna 60 affects the resonant frequency and impedance of the antenna 60, and can therefore alter the bandwidth and power efficiency of the antenna 60. Thus, the position of the feeding point 70 may be selected to achieve a desired balance between bandwidth and power efficiency. It should be understood, however, that the operational characteristics of the antenna 60, such as resonant frequency, impedance bandwidth, voltage standing wave ratio (VSWR) and power efficiency, may also be affected by varying other features of the antenna 60, such as the type of conductive material, the distance between the antenna 60 and the ground plane 72, the length of the extruded portion 68, or other physical characteristics.

Figure 7:
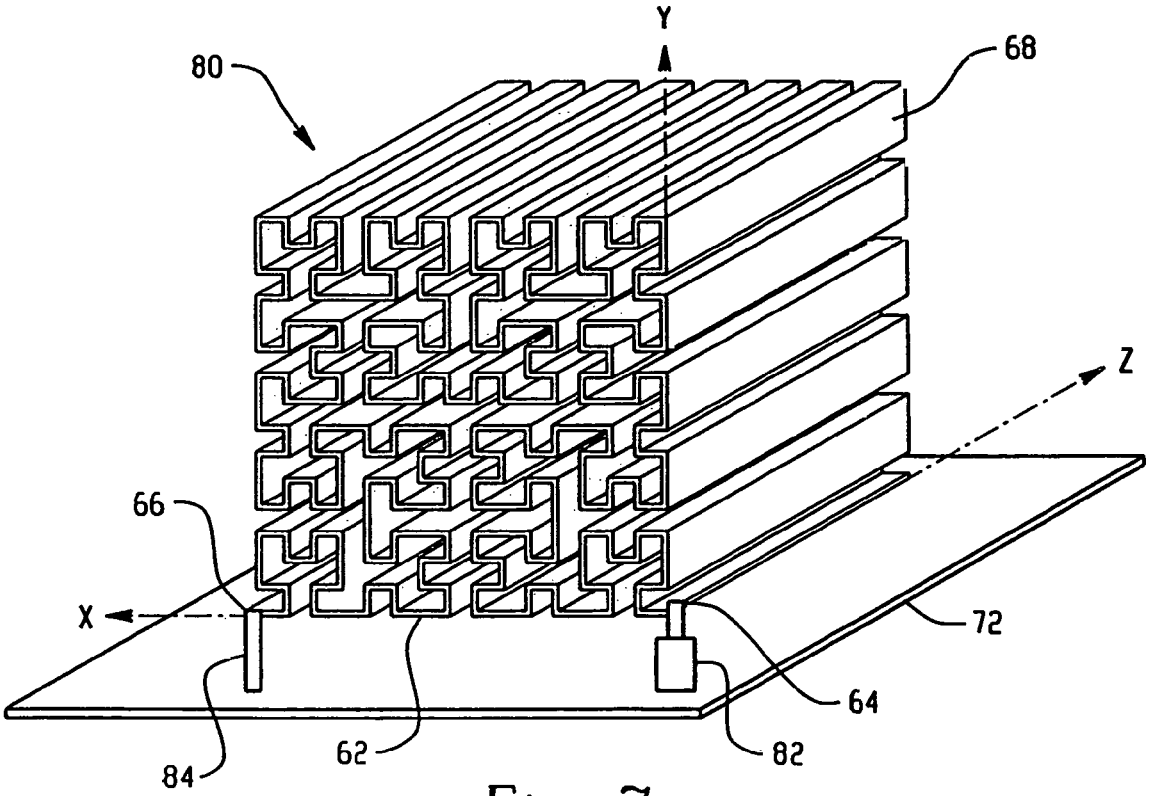
FIG. 7 is a three-dimensional view of another exemplary embodiment of a miniature antenna having an extruded volumetric structure.

FIG. 7 is a three-dimensional view of another exemplary embodiment of a miniature antenna 80 having an extruded volumetric structure. This embodiment 80 is similar to the antenna 60 described above with reference to FIG. 6, except that the feeding point 82 of the antenna is positioned at the first end point 64 of the grid dimension curve 62 and the antenna 80 includes a grounding point 84 that is coupled to the ground plane 72 at the second end point 66 of the grid dimension curve 62. As noted above, the position of the feeding point 82 affects the impedance, VSWR, bandwidth and power efficiency of the antenna 80. Similarly, coupling the antenna 80 to the ground plane 72 has an effect on the impedance, resonant frequency and bandwidth of the antenna 80.

Figure 8:
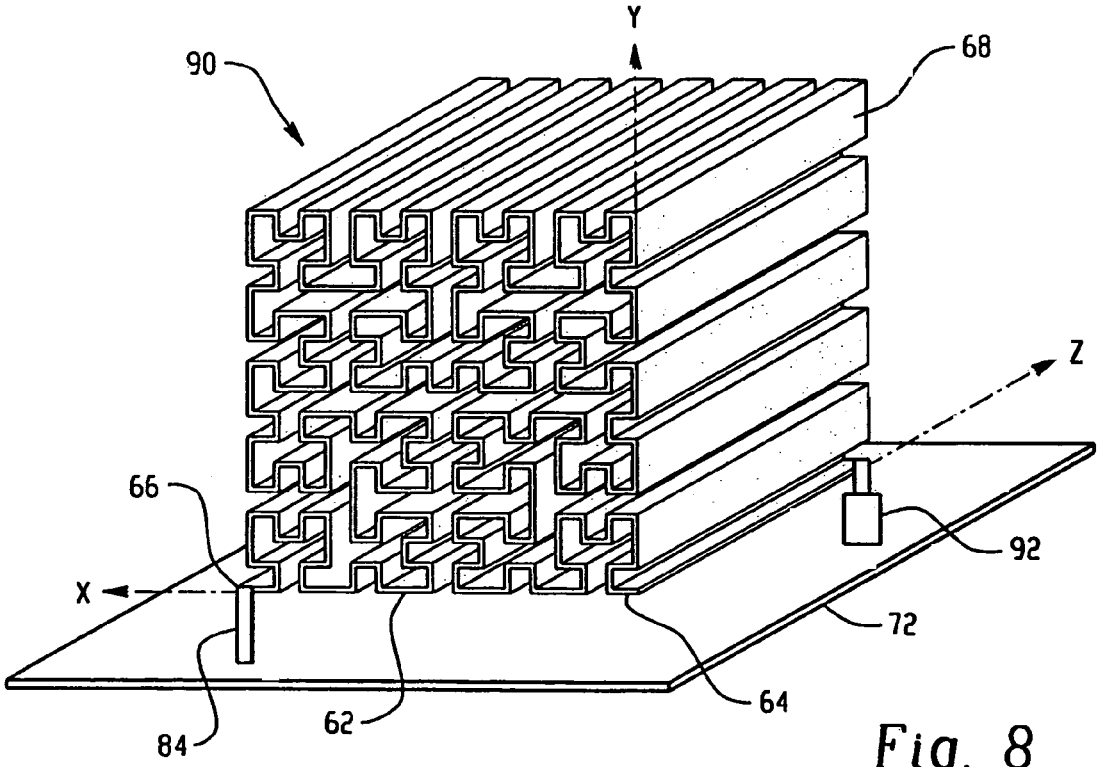
FIG. 8 is a three-dimensional view of an additional exemplary embodiment of a miniature antenna having an extruded volumetric structure.

FIG. 8 is a three-dimensional view of an additional exemplary embodiment of a miniature antenna 90 having an extruded volumetric structure. This embodiment 90 is similar to the antenna shown in FIG. 7, except that the feeding point 92 is located at a corner of the extruded portion 68 of the antenna 90 along the z axis from the first end point 64 of the grid dimension curve 62.

Figure 9:
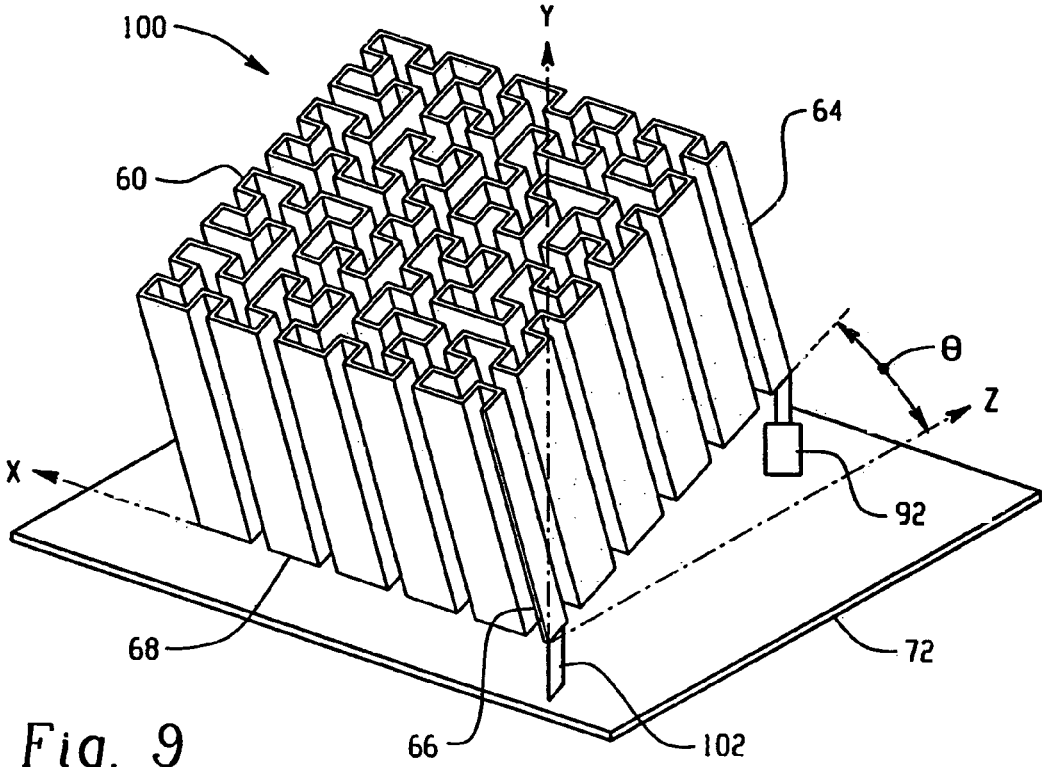
FIG. 9 is a three-dimensional view of a further exemplary embodiment of a miniature antenna having an extruded volumetric structure.

FIG. 9 is a three-dimensional view of a further exemplary embodiment of a miniature antenna 100 having an extruded volumetric structure. This embodiment 100 is similar to the embodiment 90 shown in FIG. 8, except the antenna 100 is tilted, forming an angle θ between the antenna 100 and the ground plane 72. In addition, the grounding point 102 in this embodiment 100 is coupled to a corner of the extruded portion 68 of the antenna 100 opposite the second end point 66 of the grid dimension curve 62. As noted above, the distance between the antenna 100 and the ground plane 100, as well as the grounding point position, can affect the operational characteristics of the antenna 100, such as the frequency band and power efficiency. Thus, the angle θ between the antenna 100 and the ground plane 72 can be selected to help achieve the desired antenna characteristics.

Figure 10:
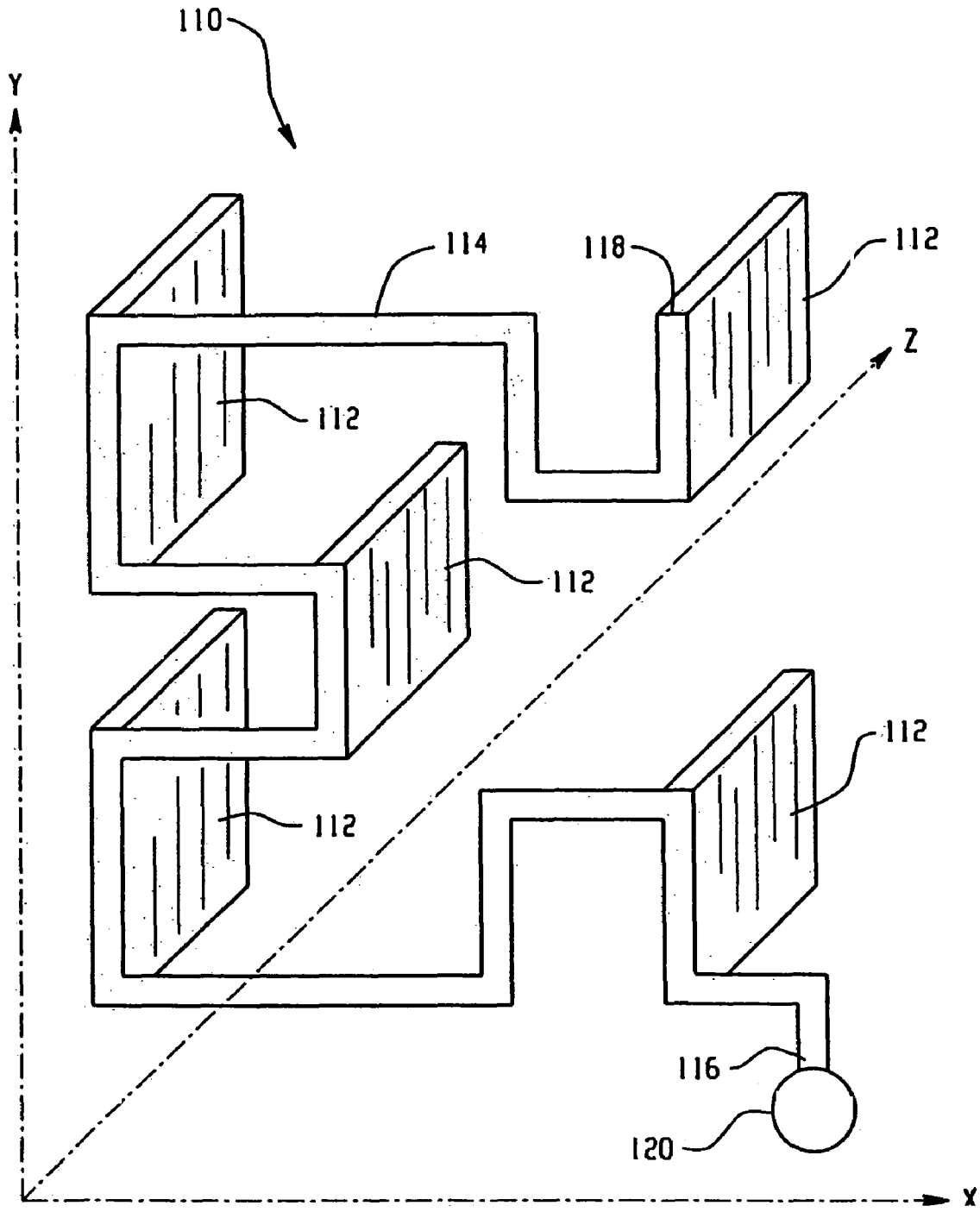
FIG. 10 is a three-dimensional view of an exemplary miniature antenna having extruded portions.

FIG. 10 is a three-dimensional view of an exemplary miniature antenna 110 having extruded portions 112. Also shown are x, y and z axes to help illustrate the orientation of the antenna 110. The antenna 110 includes a radiating arm that defines a grid dimension curve 114 in the xy plane. More particularly, the grid dimension curve 114 extends continuously in the xy plane from a first end point 116 to a second end point 118, with the feeding point 120 of the antenna 110 located at the first end point 116 of the grid dimension curve 114. In addition, sections of the grid dimension curve 114 are extruded in a direction along the z axis to form the plurality of extruded portions 112. Similar to the antennas described above, the frequency band of the antenna 110 may be tuned by changing the overall length of the grid dimension curve 114 or other physical characteristics of the antenna 110.

In the antenna embodiment 110 shown in FIG. 10, the extruded portions 112 of the antenna 110 are located on segments of the grid dimension curve 114 that are parallel with the y axis. In another similar embodiment, however, the extruded portions 112 of the antenna 100 may be located at positions along the grid dimension curve 114 that have relatively high current densities.

Figure 11A:
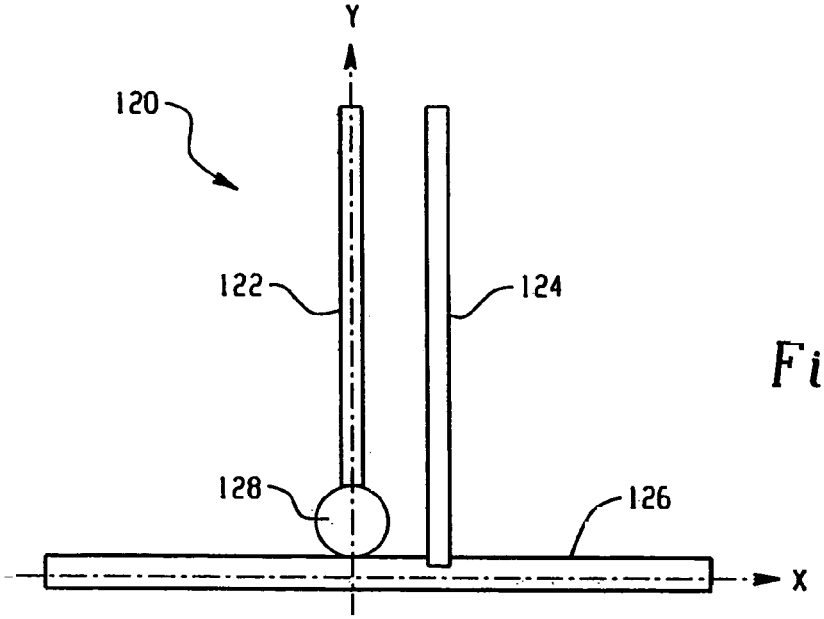
FIGS. 11A-11C show an exemplary miniature antenna with a parasitic slotted grid dimension curve.
Figure 11B:
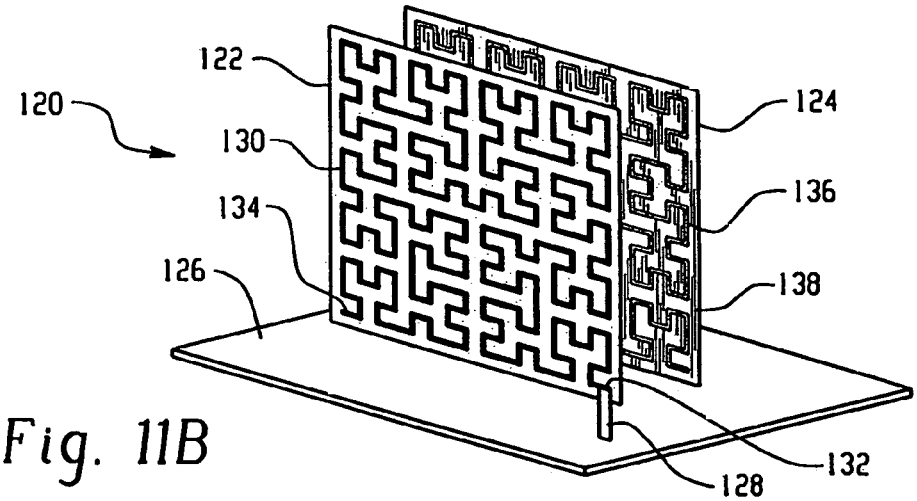
Figure 11C:
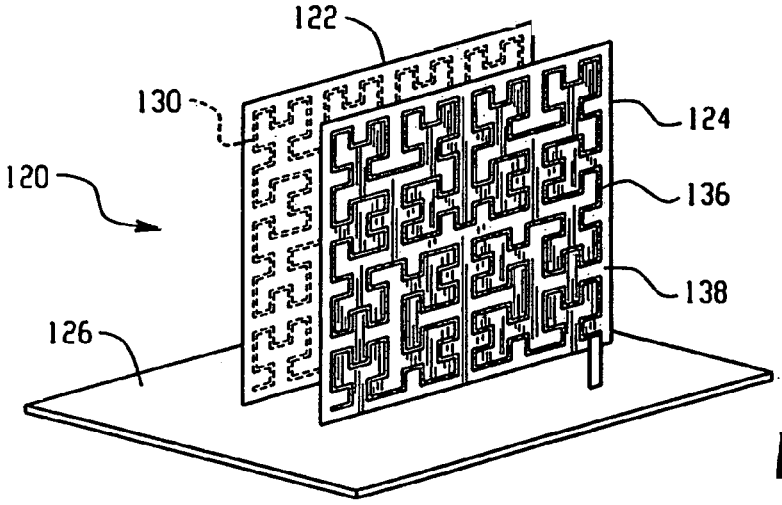

FIGS. 11A-11C show an exemplary miniature antenna 120 with a parasitic slotted grid dimension curve. The antenna 120 includes an active radiating arm 122 and a parasitic radiating arm 124. FIG. 11A is a cross-sectional view showing the orientation between the active 122 and parasitic 124 radiating arms of the antenna 120, FIG. 11B is a front view showing the active radiating arm 122 of the antenna 120, and FIG. 11C is a rear view showing the parasitic radiating arm 124 of the antenna 120.

FIG. 11A shows a cross-sectional view of the antenna 120 in an xy plane. Also illustrated is a cross-sectional view of a ground plane 126. The active radiating arm 122 is separated from the ground plane 126 by a pre-determined distance, and extends away from the ground plane 126 along the y axis. The active radiating arm 122 may, for example, be separated from the ground plane 126 by a dielectric material. The parasitic radiating arm 124 is coupled at one end to the ground plane 126 and extends away from the ground plane 126 parallel to the active radiating arm 126. The distance between the active 122 and parasitic 124 radiating arms is chosen to provide electromagnetic coupling. This electromagnetic coupling increases the effective volume and enhances the frequency bandwidth of the antenna 120. Also illustrated in FIG. 11A is an antenna feeding point 128 located on the active radiating arm 122 of the antenna 120.

FIG. 11B is a three-dimensional view showing the active radiating arm 122 of the antenna 120. The active radiating arm 122 includes a conductor 130 that defines a grid dimension curve extending continuously from a first end point 132 to a second end point 134. The feeding point 128 of the antenna 120 is preferably located at the first end point 132 of the conductor 130. The active radiating arm 122 may be fabricated by patterning the conductor 130 onto a substrate material (as shown) to form a grid dimension curve, by cutting or molding the conductor 130 into the shape of a grid dimension curve 130, or by some other suitable antenna fabrication method.

FIG. 11C is a three-dimensional view showing the parasitic radiating arm 124 of the antenna 120. The parasitic radiating arm 124 is a slot antenna that includes a grid dimension curve 136 defined by a slot in a conductive structure 138, such as a conductive plate. The conductive structure 138 is coupled to the ground plane 126. The grid dimension curve 136 in the parasitic radiating arm 124 is preferably the same pattern as the grid dimension curve 130 in the active radiating arm 122 of the antenna 120.

Figure 12:
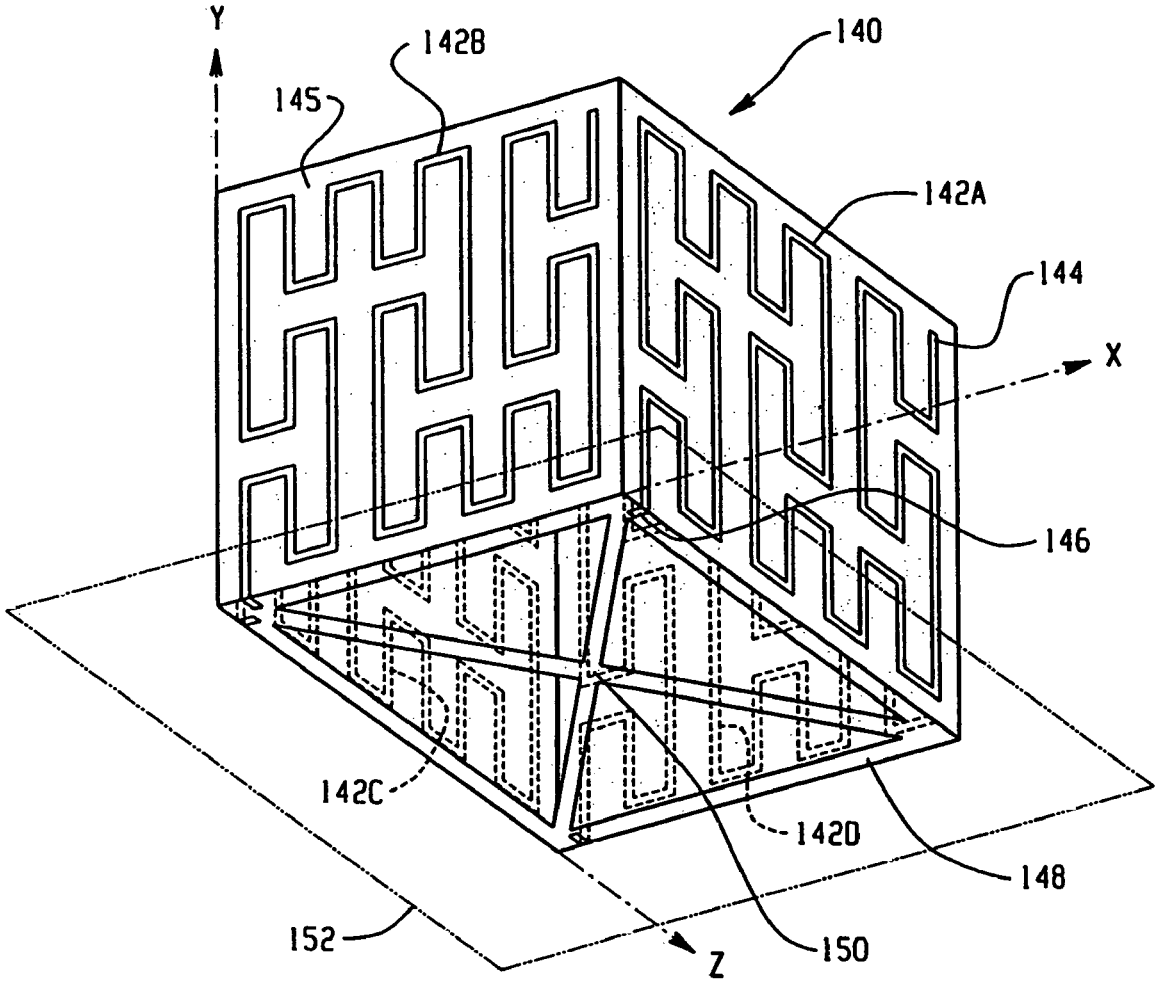
FIG. 12 is a three-dimensional view of an exemplary miniature antenna with four parallel-fed radiating arms arranged in a volumetric structure.

FIG. 12 is a three-dimensional view of an exemplary miniature antenna 140 with four parallel-fed radiating arms 142A-142D arranged in a volumetric structure. Also shown are x, y, and z axes to help illustrate the orientation of the antenna 140. Each of the four radiating arms 142A-142D is a conductor that defines a grid dimension curve in a plane perpendicular to the xz plane, and is coupled at one end to a common feeding portion 148, 150. The radiating arms 142A-142D may be attached to a dielectric substrate 145 (as shown), but may alternatively be formed without the dielectric substrate 145, for example, by cutting or molding a conductive material into the shape of the grid dimension curve, or by some other suitable method. Also shown is a ground plane 152 that is separated from the common feeding point 148, 150 by some pre-defined distance. The ground plane 152 could, for example, be separated from the antenna 140 by a dielectric material.

Each radiating arm 142A-142D is aligned perpendicularly with two other radiating arms, forming a box-like structure with open ends. More particularly, a first radiating arm 142A defines a grid dimension curve parallel to the yz plane, a second radiating arm 142B defines a grid dimension curve in the xy plane, a third radiating arm 143C defines a grid dimension curve in the yz plane, and a fourth radiating arm 143D defines a grid dimension curve parallel to the xy plane. Each grid dimension curve 142A-142D includes a first end point 144 and extends continuously within its respective plane to a second end point 146 that is coupled to the common feeding portion 148, 150.

The common feeding portion 148, 150 includes a rectangular portion 148 that is coupled to the second end points 146 of the four radiating arms 142A-142D, and also includes an intersecting portion 150. The center of the intersecting portion 150 may, for example, be the feeding point of the antenna that is coupled to a transmission medium, such as a transmission wire or circuit trace. In other exemplary embodiments, the common feeding portion 148, 150 could include only the rectangular portion 148 or the intersecting portion 150, or could include some other suitable conductive portion, such as a solid conductive plate.

In operation, the frequency band of the antenna 140 is defined in significant part by the respective lengths of the radiating arms 142A-142D. In order to achieve a larger bandwidth, the lengths may be slightly varied from one radiating arm to another, such that the radiating arms 142A-142D resonate at different frequencies and have overlapping bandwidths. Similarly, a multi-band antenna may be achieved by varying the lengths of the radiating arms 142A-142D by a greater amount, such that the resonant frequencies of the different arms 142A-142D do not result in overlapping bandwidths. It should be understood, however, that the antenna's operational characteristics, such as bandwidth and power efficiency, may be altered by varying other physical characteristics of the antenna. For example, the impedance of the antenna may be affected by varying the distance between the antenna 140 and the ground plane 152.

Figure 13:
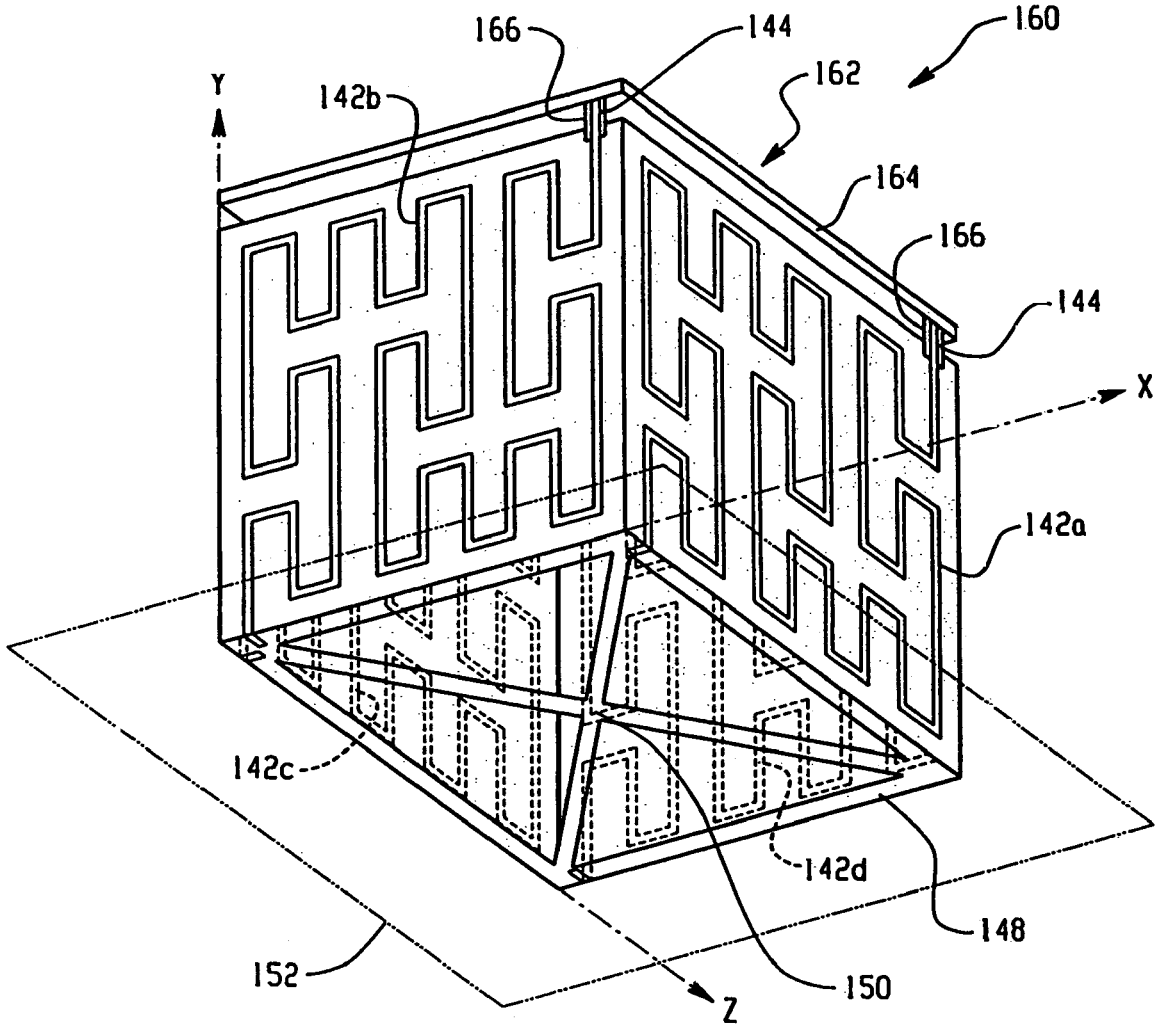
FIG. 13 shows one alternative embodiment of the exemplary miniature antenna of FIG. 12 that includes a top-loading portion.

FIG. 13 shows one alternative embodiment 160 of the exemplary miniature antenna 140 of FIG. 12 that includes a top-loading portion 162. This antenna 160 is similar to the antenna 140 described above with reference to FIG. 12, except that a top-loading portion 162 is coupled to each of the radiating arms 142A-142D. The top-loading portion 162 includes a solid conductive portion 164 that is aligned above (along the y axis) the radiating arms 142A-142D in the xz plane, and four protruding portions 166 that electrically couple the solid conductive portion 164 to the first end points 144 of each of the radiating arms 142A-142D.

Figure 14:
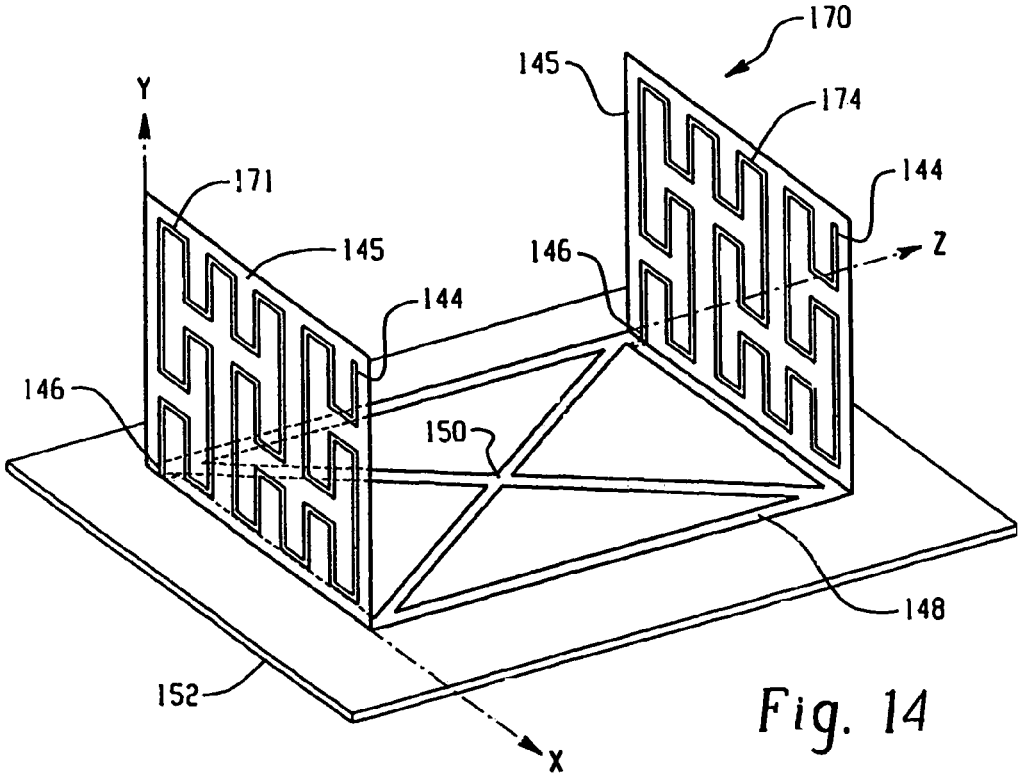
FIG. 14 is a three-dimensional view of an exemplary miniature antenna with two parallel-fed vertically stacked radiating arms.

FIG. 14 is a three-dimensional view of an exemplary miniature antenna 170 with two parallel-fed vertically stacked radiating arms 171, 174. This antenna 170 is similar to the antenna 140 shown in FIG. 12, except that only two radiating arms 171, 174 are included in this embodiment 170. A first radiating arm 171 is a conductor that defines a grid dimension curve in the xy plane, and a second radiating arm 174 is a conductor that forms a grid dimension curve parallel to the first radiating arm. Both radiating arms 171, 174 are coupled to a common feeding portion 148, 150, as described above with reference to FIG. 12.

Figure 15:
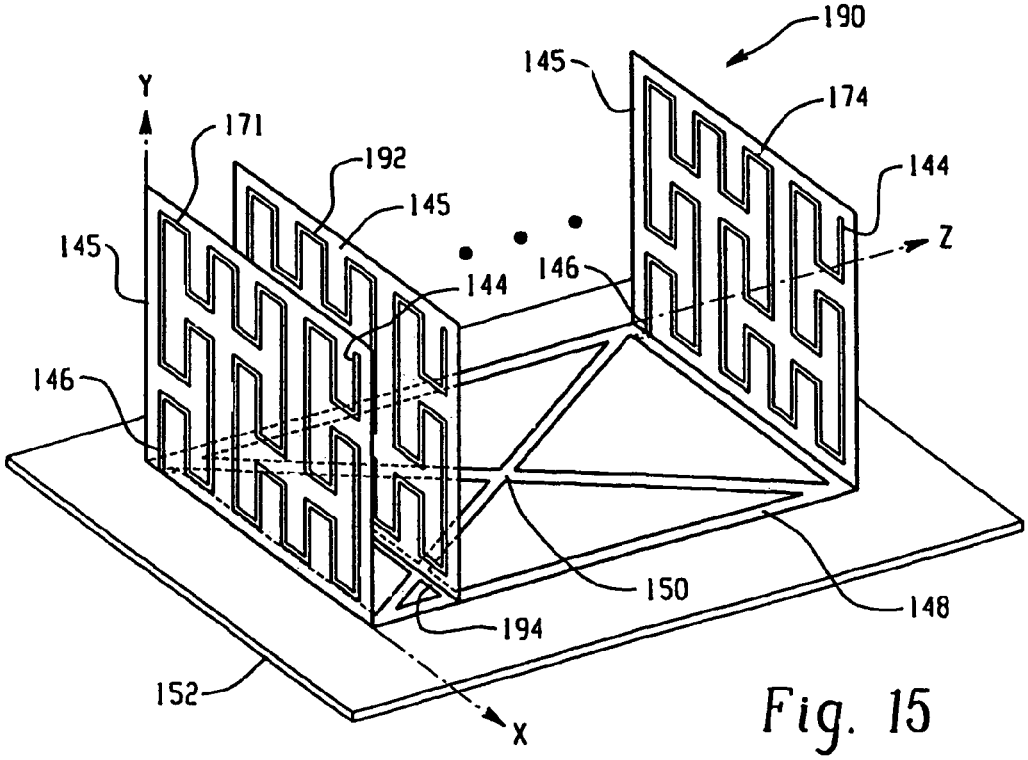
FIG. 15 shows one alternative embodiment of the exemplary miniature antenna of FIG. 14 that includes three or more parallel-fed vertically stacked radiating arms.

FIG. 15 shows one alternative embodiment 190 of the exemplary miniature antenna 170 of FIG. 14 that includes three or more parallel-fed vertically stacked radiating arms. This embodiment 190 is similar to the antenna 170 shown in FIG. 14, except at least one additional radiating arm 192 is included that defines a grid dimension curve(s) parallel to the first two radiating arms 171, 174. In addition, one or more additional segment(s) 194 is added to the common feeding portion 148, 150 in order to couple the feeding portion 148, 150, 194 to the additional grid dimension curve(s) 192.

Figure 16:
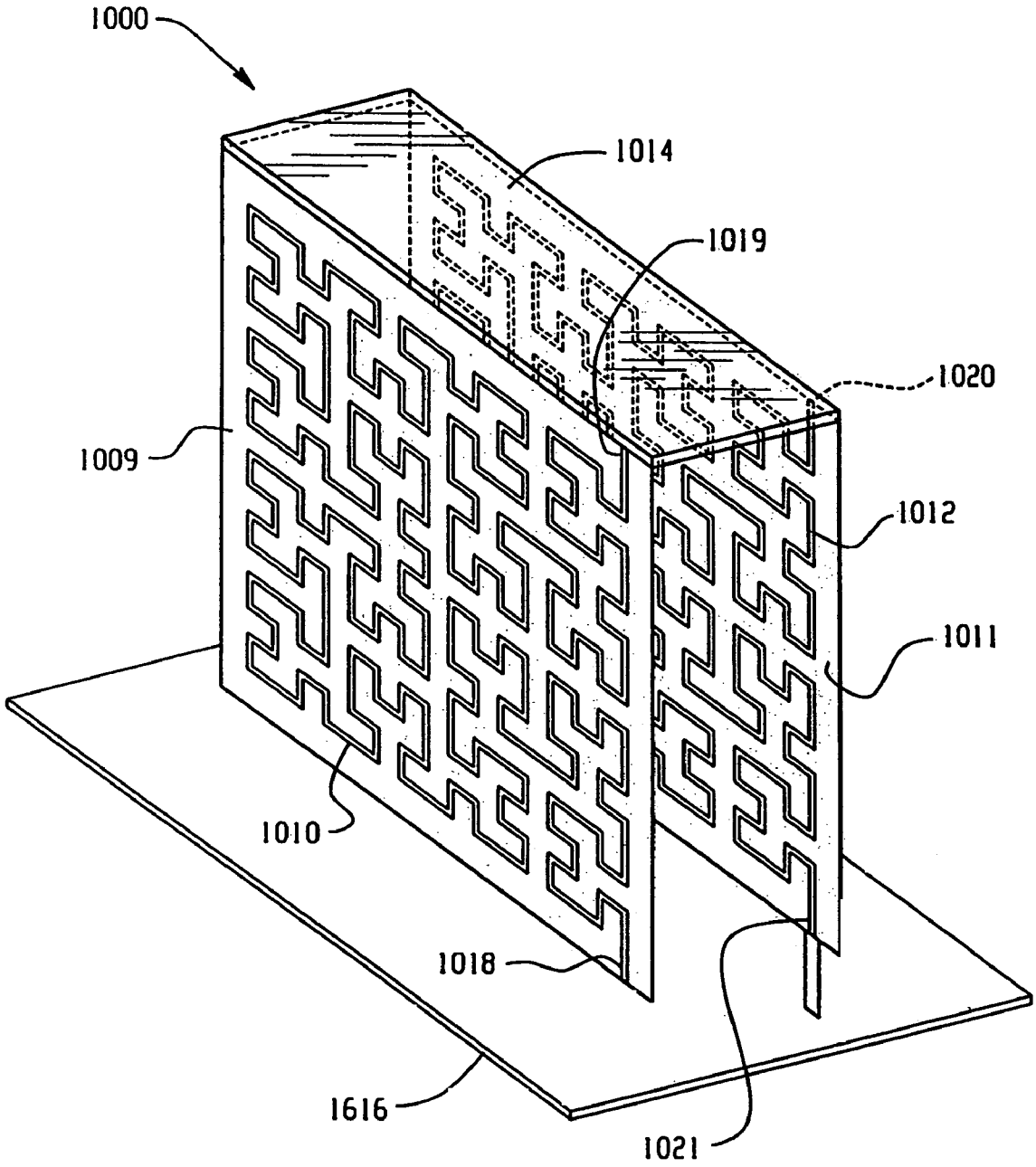
FIG. 16 is a three-dimensional view of an exemplary miniature folded monopole antenna.

FIG. 16 is a three-dimensional view of an exemplary miniature folded monopole antenna 1000. The antenna 1000 includes a radiating arm with a vertical portion 1009, a folded portion 1011, and a top portion 1014. Also illustrated is a ground plane 1016. The vertical portion 1009 includes a conductor 1010 that defines a first grid dimension curve in a plane perpendicular to the ground plane 1016. Similarly, the folded portion 1011 includes a conductor 1012 that defines a second grid dimension curve in a plane perpendicular to the ground plane 1016 and parallel with the vertical portion 1009.

The top portion 1014 includes a conductive plate that couples the first grid dimension curve 1010 to the second grid dimension curve 1012. In other embodiments, however, the top portion 1014 may include a conductive trace or other type of conductor to couple the first and second grid dimension curves 1010, 1012. In one embodiment, for example, the top portion may define another grid dimension curve that couples the first and second grid dimension curves 1010, 1012.

The first grid dimension curve 1010 includes a first end point 1018 and extends continuously to a second end point 1019. The antenna 1000 is preferably fed at or near the first end point 1018 of the first grid dimension curve 1010. Similarly, the second grid dimension curve 1012 includes a first end point 1020 and extends continuously to a second end point 1021, which is coupled to the ground plane 1016. The second end point 1019 of the first grid dimension curve 1010 is coupled to the first end point 1020 of the second grid dimension curve 1012 by the conductor on the top portion 1014 of the antenna 1000, forming a continuous conductive path from the antenna feeding point to the ground plane 1016.

Figure 17:
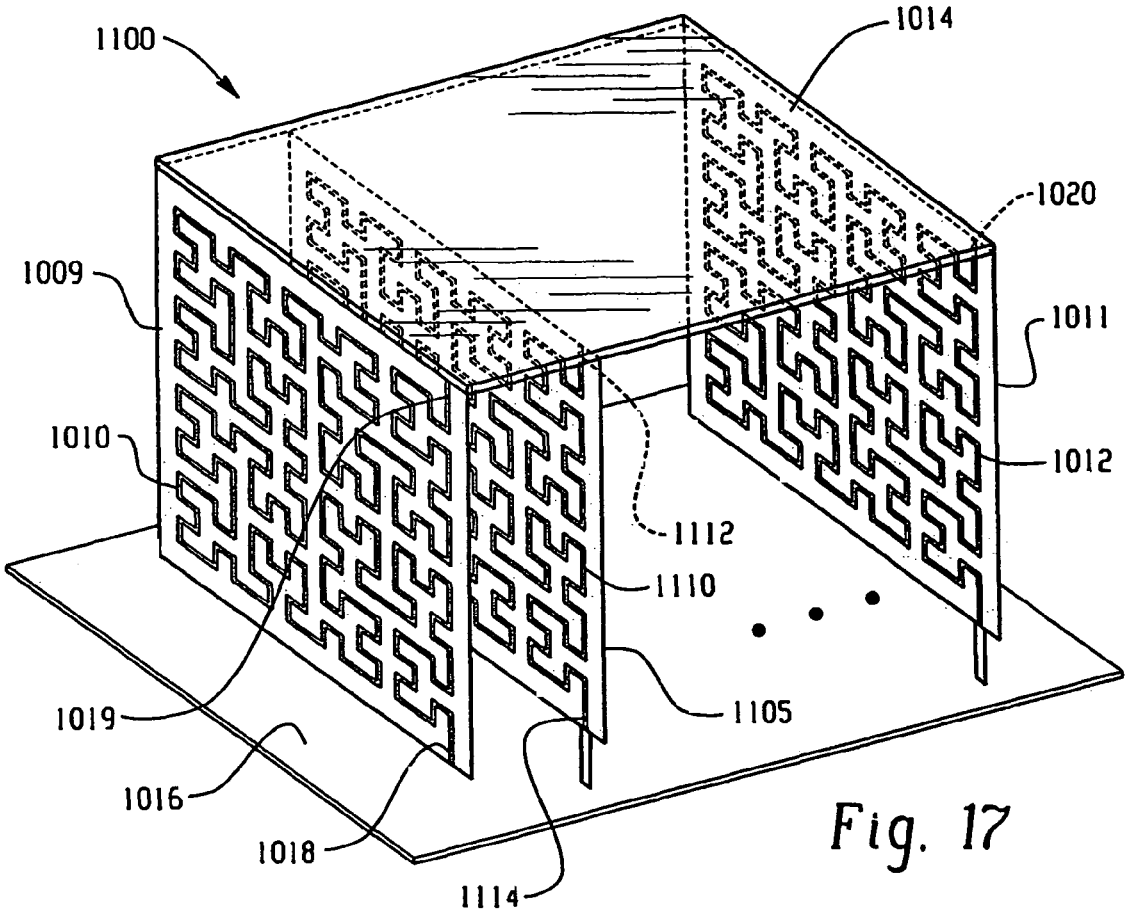
FIG. 17 shows one alternative embodiment of the exemplary miniature antenna of FIG. 16 that includes two or more folded portions.

FIG. 17 shows one alternative embodiment 1100 of the exemplary miniature antenna 1000 of FIG. 16 that includes a vertical portion 1009 and two or more folded portions 1011, 1105. This embodiment 1100 is similar to the antenna 1000 described above with respect to FIG. 16, with the addition of at least one additional folded portions(s) 1105. The additional folded portion(s) 1105 includes a conductor(s) 1110 that defines an additional grid dimension curve(s) in a plane perpendicular to the ground plane 1016 and parallel to the vertical portion 1009. More particularly, the additional grid dimension curve(s) 1110 includes a first end point 1112 coupled to the top portion 1014, and extends continuously from the first end point 1112 to a second end point 1114, which is coupled to the ground plane 1016. The inclusion of the additional folded portion(s) 1105 in the antenna structure 1100 may, for example, increase the bandwidth and power efficiency of the antenna 1100.

Figure 18A:
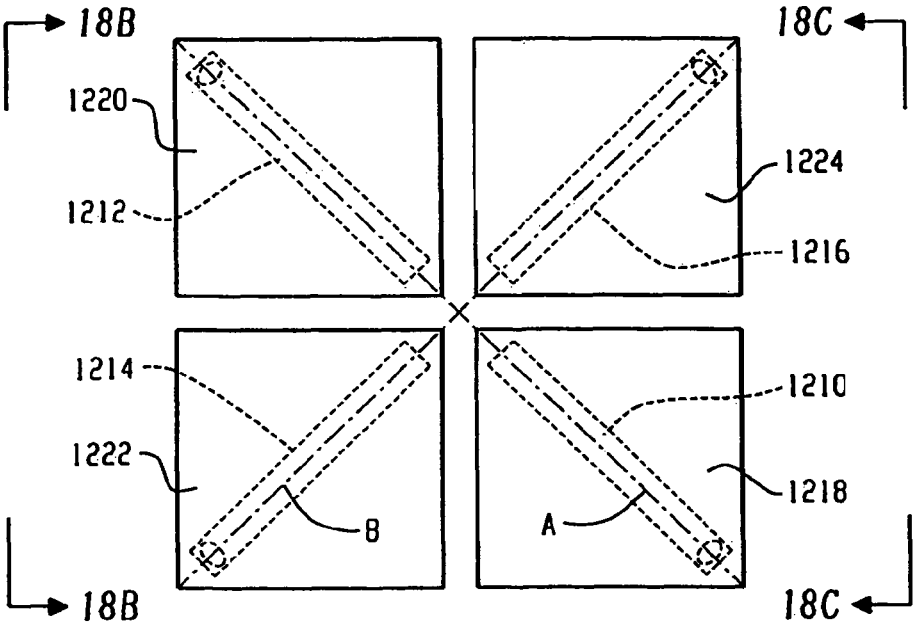
FIGS. 18A-18C show an exemplary miniature antenna having an active radiating arm and a plurality of parasitic radiating arms.
Figure 18C:
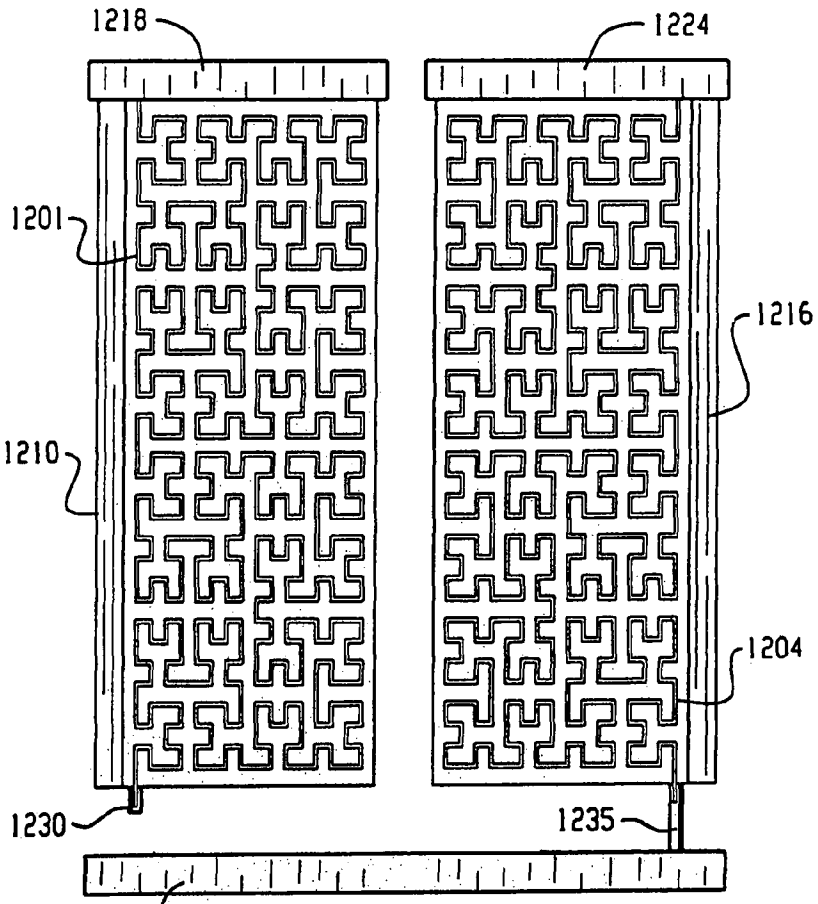
Figure 18B:
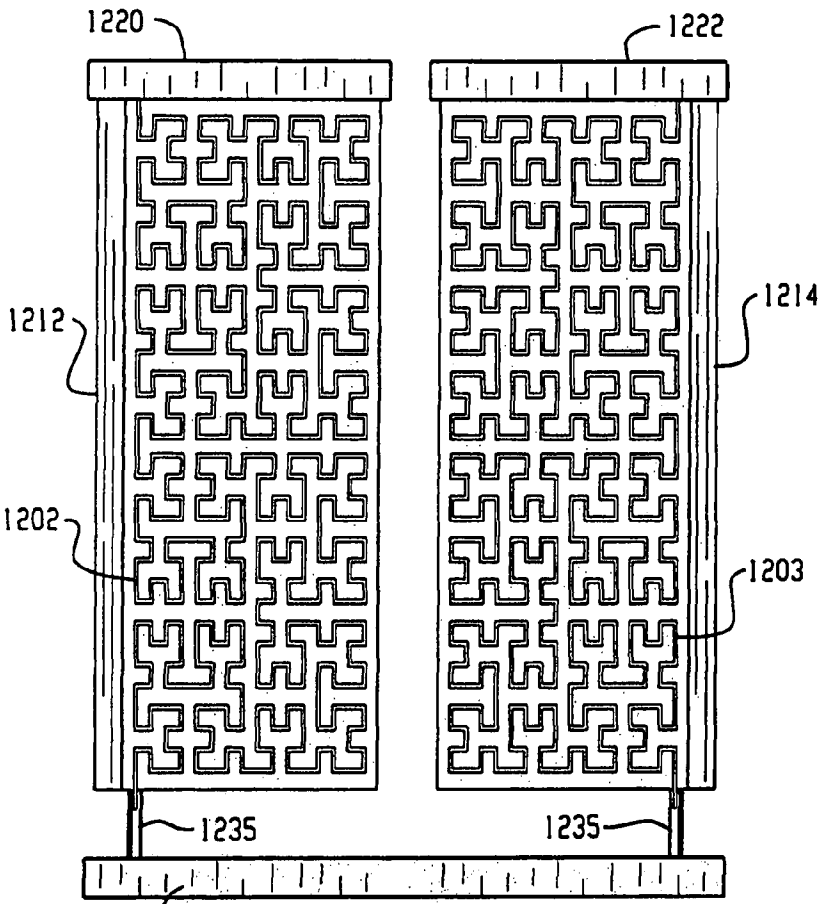

FIGS. 18A-18C show an exemplary miniature antenna 1200 having an active radiating arm 1210 and three parasitic radiating arms 1212-1216. FIG. 18A is a top view of the antenna 1200, and FIGS. 18B and 18C are respective side views of the antenna 1200.

With reference to FIG. 18A, the antenna 1200 includes four top loading portions 1218-1224 that are perpendicular to the four radiating arms 1210-1216. FIG. 18 shows a top view of the top-loading portions 1218-1224 and cross-sectional view of the four radiating arms 1210-1216. The cross-sections of the active radiating arm 1210 and one of the parasitic radiating arms 1214 are aligned in a first plane (A), and the cross-sections of the other two parasitic radiating arms 1212, 1216 are aligned in a second plane (B) that is perpendicular to both the first plane (A) and the plane of the top-loading portions 1218-1224 (i.e., the plane of the paper). The illustrated top-loading portions 1218-1224 include a rectangular-shaped conductive surface. It should be understood, however, that the top-loading portions 1218-1224 could include other conductive surfaces, such as a conductor defining a grid dimension curve. It should also be understood that differently shaped top-loading portions 1218-1224 could also be utilized.

The edges of the top-loading portions 1218-1224 are aligned such that there is a pre-defined distance between adjacent top-loading portions. The pre-defined distance between adjacent top-loading portions 1218-1224 is preferably small enough to allow electromagnetic coupling. In this manner, the top-loading portions 1218-1224 provide improved electromagnetic coupling between the active and parasitic radiating arms 1210-1216 of the antenna 1200.

With reference to FIGS. 18B and 18C, the active radiating arm 1210 and three parasitic radiating arms 1212-1216 of the antenna 1200 each include conductors 1201-1204 that define a grid dimension curve in a plane perpendicular to the top loading portions 1218-1224 and a ground plane 1228. The four grid dimension curves 1201-1204 are respectively coupled to the four top-loading portions 1218-1224. The grid dimension curve 1201 on the active radiating arm 1210 of the antenna 1200 includes a first end point 1230 and extends continuously to a second end point that is coupled to the conductive surface of one top-loading portion 1218. The feeding point of the antenna 1200 is preferably located at or near the first end point 1230 of the active radiating arm 1210. The grid dimension curves 1202-1204 on the three parasitic radiating arms 1212-1216 each include a first end point 1235 coupled to the ground plane 1228, and extend in a continuous path from the first end point 1235 to a second end point coupled to one of the top-loading portions 1220-1224.

Figure 18D:
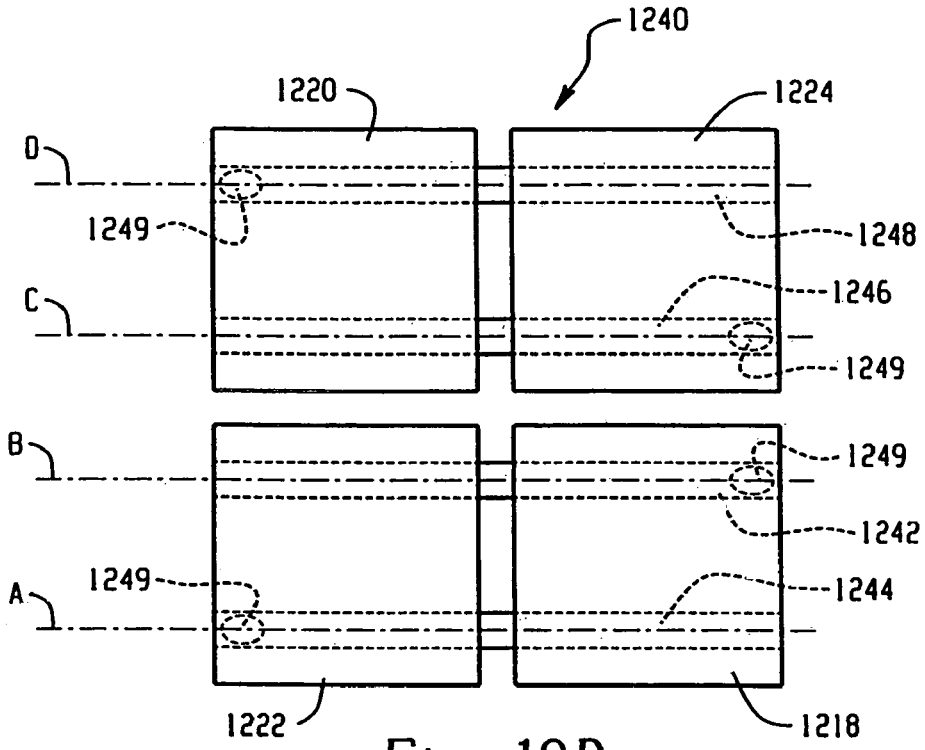
FIGS. 18D and 18E show two alternative configurations for the miniature antenna of FIGS. 18A-18C.
Figure 18E:
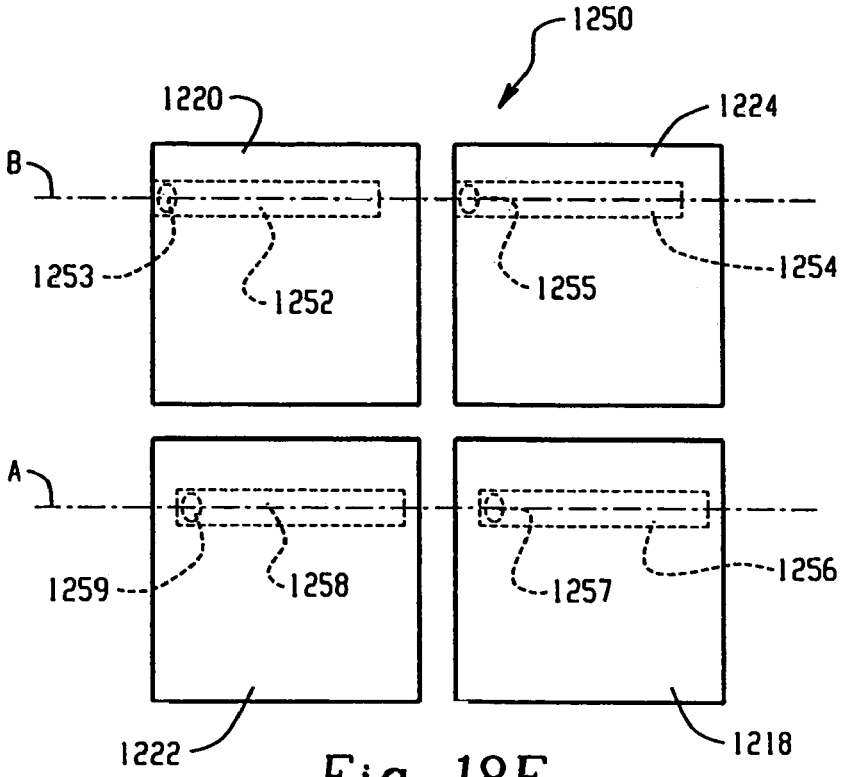

FIGS. 18D and 18E show two alternative configurations for the miniature antenna of FIGS. 18A-18C. FIG. 18D is a top view showing one exemplary embodiment 1240 in which the active radiating arm 1242 and the three parasitic radiating arms 1244-1248 of the antenna 1240 are aligned in parallel planes (A-D). In addition, the active radiating arm 1242 and parasitic radiating arms 1244-1248 in this embodiment 1240 are each adjacent to two top-loading portions 1218-1224. The end points 1249 of the respective grid dimension curves 1201-1204 are each coupled to one top-loading portion 1218-1224. FIG. 18E is a top view showing another exemplary embodiment 1250 in which the active radiating arm 1256 is aligned in a first plane (A) with one parasitic radiating arm 1258, and the two other parasitic radiating arms 1252, 1255 are aligned in a second plane (B) that is parallel to the first plane.

Figure 19A:
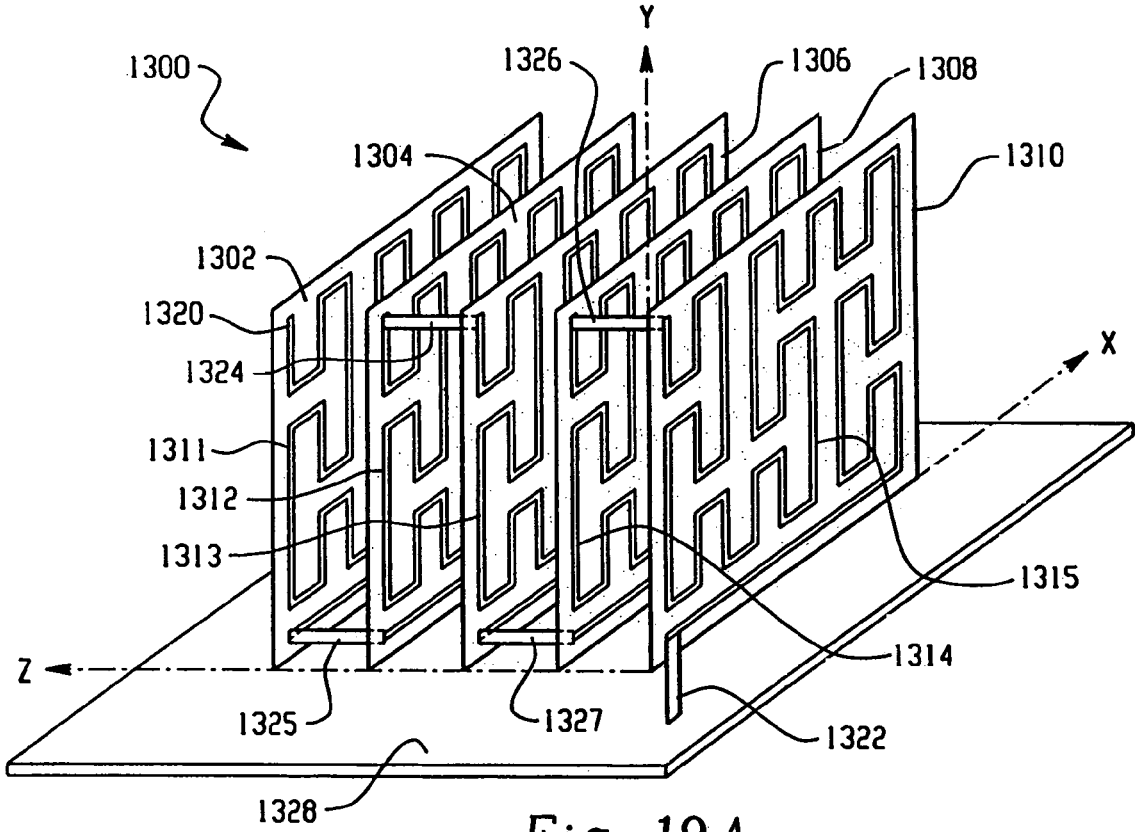
FIGS. 19A and 19B show an exemplary miniature antenna with a plurality of half-wavelength resonant radiating arms.
Figure 19B:
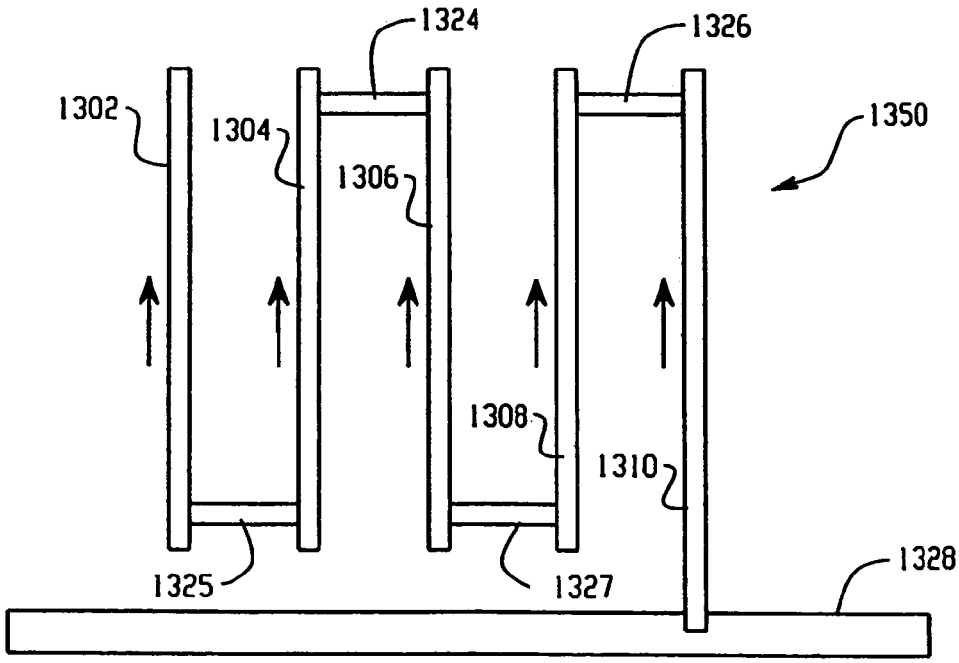

FIGS. 19A and 19B show an exemplary miniature antenna 1300 with a plurality of half-wavelength resonant radiating arms 1302-1310. FIG. 19A is a three-dimensional view of the antenna 1300 showing the orientation of the antenna 1300 with reference to a ground plane 1328. Also shown in FIG. 19A are x, y, and z axes to help illustrate the orientation of the antenna 1300. The antenna 1300 includes five radiating arms 1302-1310 that are each aligned parallel with one another and perpendicular to the ground plane 1328, and four connector segments 1324-1327. Each radiating arm 1302-1310 includes a conductor 1311-1315 that defines a grid dimension curve in the plane of the respective radiating arm 1302-1310. The antenna conductors 1311-1315 may be attached to a dielectric substrate (as shown), or may alternatively be formed without a dielectric substrate, for example, by cutting or molding the conductor 1311-1315 into the shape of a grid dimension curve.

The grid dimension curves 1311-1315 are coupled together at their end points by the connector segments 1324-1327, forming a continuous conductive path from a feeding point 1320 on the left-most radiating arm 1302 to a grounding point 1322 on the right-most radiating arm 1310 that is coupled to the ground plane 1328. In addition, the length of each grid dimension curve 1311-1315 is chosen to achieve a 180° phase shift in the current in adjacent radiating arm 1302-1310.

FIG. 19B is a schematic view 1350 of the antenna 1300 illustrating the current flow through each radiating arm 1302-1310. As a result of the 180° phase shift, the current in each radiating arm 1302-1310 radiates in the same vertical direction (along the y axis), causing all parallel radiating arms 1302-1310 to contribute in phase to the radiation.

Figure 20A:
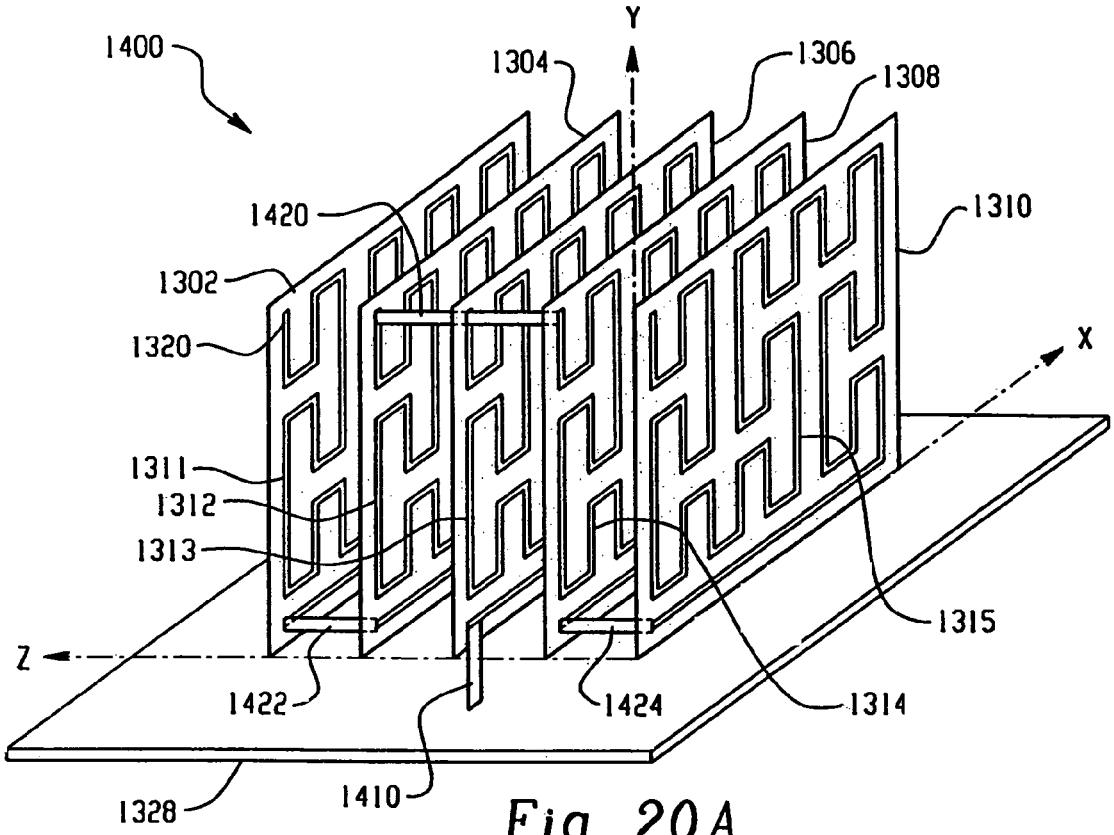
FIGS. 20A and 20B show one alternative embodiment of the miniature antenna of FIGS. 19A and 19B.
Figure 20B:
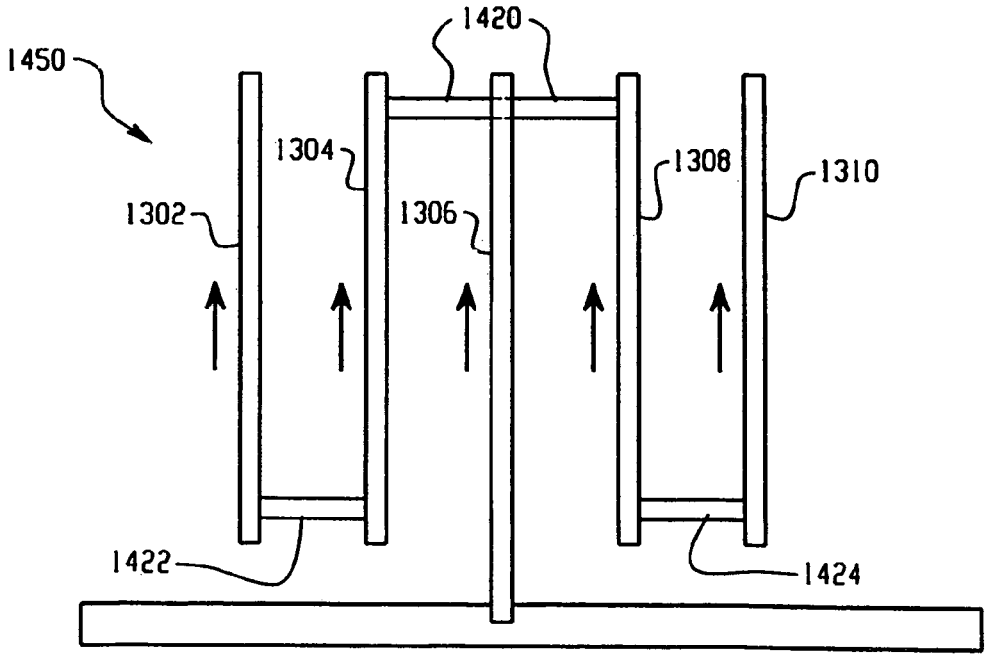

FIGS. 20A and 20B show one alternative embodiment 1400 of the miniature antenna 1300 of FIGS. 19A and 19B. FIG. 20A is a three-dimensional view showing the orientation of the antenna 1400. This embodiment 1400 is similar to the miniature antenna 1300 of FIG. 19A except that the feeding point 1410 of the antenna 1400 is located at an end point of the grid dimension curve 1313 on the center-most radiating arm 1306, effectively forming a monopole antenna with two symmetrical branches. One antenna branch is formed by the two left-most radiating arms 1302, 1304, and the other branch is formed by the two right-most radiating arms 1308, 1310. In addition, the antenna 1400 includes an upper connector portion 1420 and two lower connector portions 1422, 1424. The upper connector portion 1420 couples together one end point from each of the three center grid dimension curves 1312, 1313, 1314, and the two lower connector portions 1422, 1424 each couple together end points of the grid dimension curves 1311, 1312, 1314, 1315 in the respective symmetrical branches. In addition, the length of each grid dimension curve 1311-1315 is selected to achieve a 180° phase shift in the current in adjacent radiating arms 1302-1310.

FIG. 20B is a schematic view 1450 of the antenna 1400 illustrating the current flow through each radiating arm 1302-1310. As described above, the 180° phase shift causes the current in each radiating arm 1302-1310 to radiate in the same vertical direction (along the y axis).

Figure 21A:
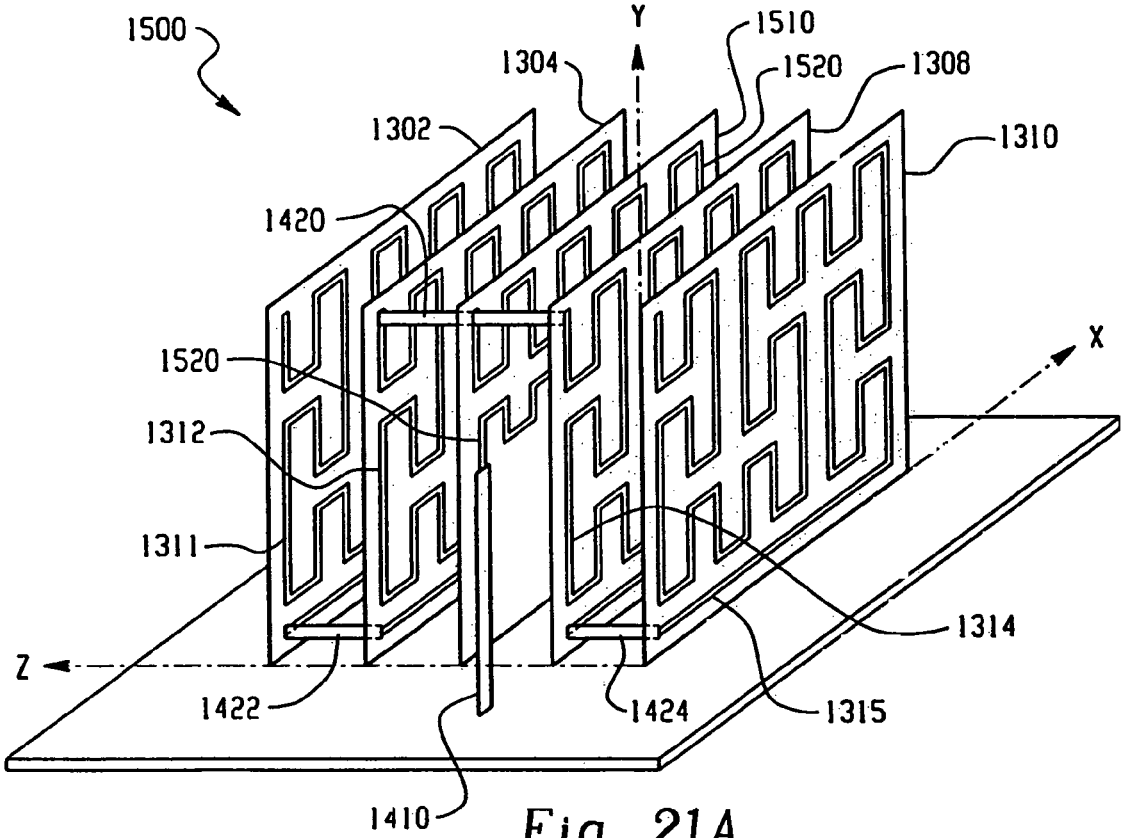
FIGS. 21A and 21B show an alternative embodiment of the miniature antenna of FIGS. 20A and 20B having a quarter wavelength center-feed radiating arm.
Figure 21B:
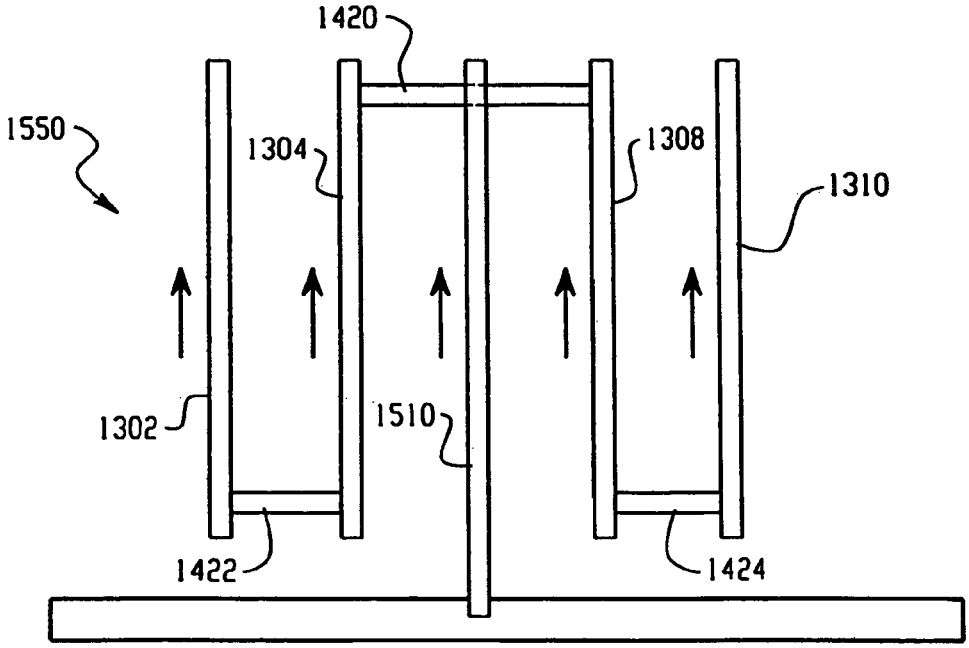

FIGS. 21A and 21B show an alternative embodiment 1500 of the miniature antenna 1400 of FIGS. 20A and 20B having a quarter wavelength center-feed radiating arm 1510. FIG. 21A is a three-dimensional view showing the orientation of the antenna 1500. This embodiment 1500 is similar to the antenna 1400 of FIG. 20A, except that the grid dimension curve 1520 on the center-most radiating arm 1510 is shorter in length than the grid dimension curves 1311, 1312, 1314, 1315 on the other four radiating arms 1302, 1304, 1308, 1310. The length of the center-most grid dimension curve 1520 is selected to achieve a 90° phase shift in current between the center-most radiating arm 1510 and the adjacent radiating arms 1304, 1308. The lengths of the other four radiating arms 1302, 1304, 1308, 1310 are chosen to achieve a 180° phase shift in current, as described above.

FIG. 21B is a schematic view 1550 of the antenna illustrating the current flow through each radiating arm 1302, 1304, 1308, 1310, 1510. Similar to the antenna 1400 described above with reference to FIG. 20B, the 90° and 180° phase shifts in this antenna embodiment cause the current in each radiating arm 1302, 1304, 1308, 1310, 1510 to radiate in the same vertical direction (along the y axis). The shorter length of the center grid dimension curve 1520 may, however, be desirable to tune the impedance of the antenna.

Figure 22A:
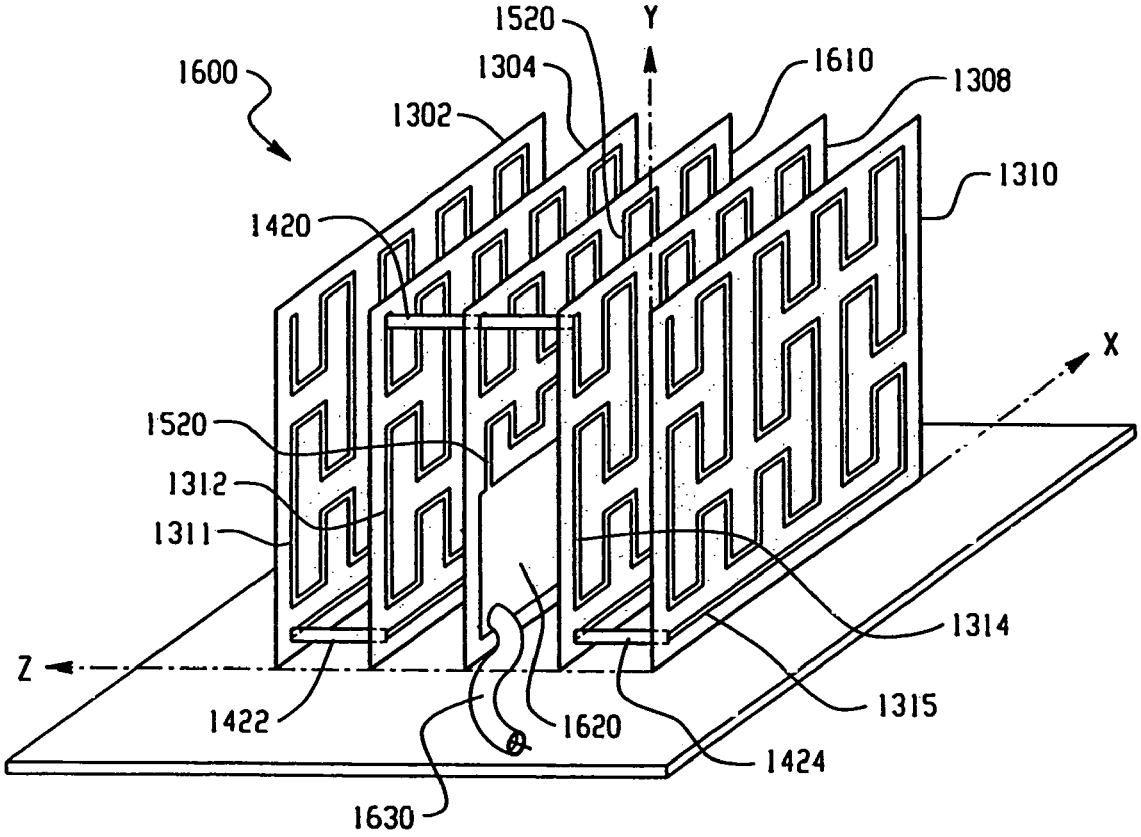
FIGS. 22A and 22B show another alternative embodiment of the miniature antenna of FIGS. 21A and 21B.
Figure 22B:
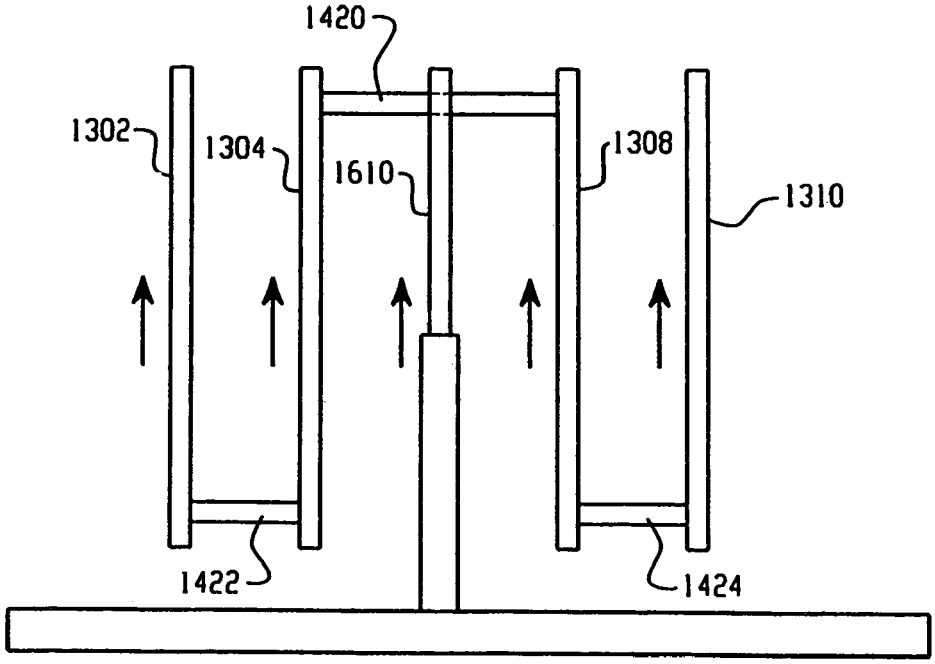

FIGS. 22A and 22B show another alternative embodiment 1600 of the miniature antenna 1500 of FIGS. 21A and 21B. FIG. 22A is a three-dimensional view showing the orientation of the antenna 1600. This antenna embodiment 1600 is similar to the antenna 1500 of FIG. 21A, except the center-most radiating arm 1610 includes a solid conductive portion 1620 coupled to an end point of the center grid dimension curve 1520. The solid conductive portion 1620 may, for example, function as a feeding point to couple the center grid dimension curve 1520 to a transmission medium 1630, such as a coaxial cable. As noted above, the length of the center-most grid dimension curve 1520 is selected to achieve a 90° current phase shift, and the lengths of the other four radiating arms 1302, 1304, 1308, 1310 are chosen to achieve a 180° current phase shift.

FIG. 22B is a schematic view 1650 of the antenna 1600 illustrating the current flow through each radiating arm 1302, 1304, 1610, 1308, 1310. As noted above, the 90° and 180° phase shifts cause the current in each radiating arm 1302, 1304, 1610, 1308, 1310 to radiate in the same vertical direction (along the y axis).

Figure 23A:
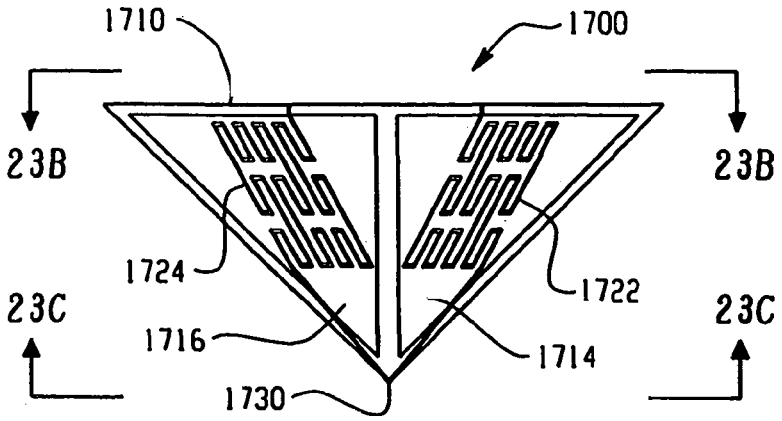
FIGS. 23A-23C show an exemplary miniature antenna having a pyramidal structure.
Figure 23B:
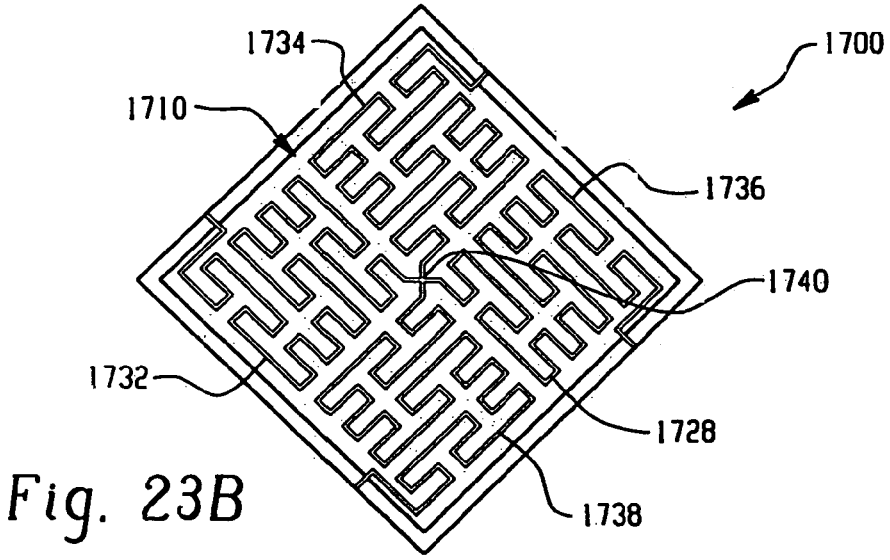
Figure 23C:
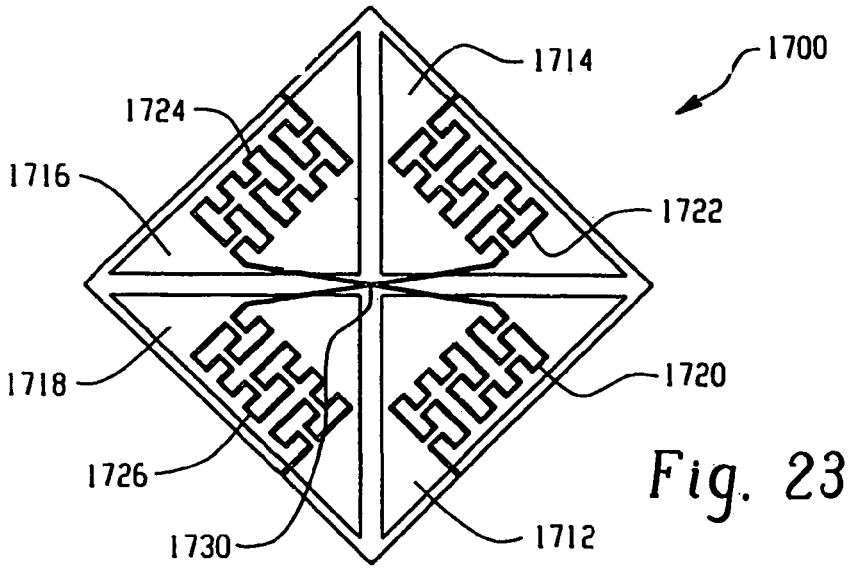

FIGS. 23A-23C show an exemplary miniature antenna 1700 having a pyramidal structure. The antenna 1700 includes a square-shaped base 1710 and four triangular-shaped surfaces 1712-1718 that are coupled together at the edges to form a four-sided pyramid. FIG. 23A is a side view of the antenna 1700 showing two of the four triangular-shaped surfaces 1714, 1716. FIG. 23B is a top view showing the square-shaped base 1710 of the antenna 1700. FIG. 23C is a bottom view of the antenna 1700 showing the four triangular-shaped surfaces 1712-1718.

With reference to FIGS. 23A and 23C, the four triangle-shaped surfaces 1712-1718 of the antenna 1700 each include a conductor 1720-1726 that defines a grid dimension curve in the plane of the respective surface 1712-1718. One end point of each of the grid dimension curves 1720-1726 is coupled to a common feeding point 1730, preferably located at or near the apex of the pyramid. The other end point of the grid dimension curves 1720-1726 is coupled to the square-shaped base 1720, as shown in FIG. 23B. Schematically, the grid dimension curves 1720-1726 form four parallel conductive paths from the common feeding point 1730 to the square-shaped base 1710.

With reference to FIG. 23B, the square-shaped base 1710 includes conductors 1732-1738 that define four additional grid dimension curves. Each grid dimension curve 1732-1738 on the base 1710 is coupled at one end point to one of the grid dimension curves 1720-1726 on the triangular-shaped surfaces 1712-1718 of the antenna 1700. The other end points of the grid dimension curves 1732-1738 on the square-shaped base 1710 are coupled together at one common point 1740. In one embodiment, the common point 1740 on the base 1710 of the antenna 1700 may be coupled to a ground potential to top load the antenna 1700.

It should be understood that, in other embodiments, the antenna 1700 could instead include a differently-shaped base 1718 and a different number of triangular-shaped surfaces 1712-1718S. For instance, one alternative embodiment of the antenna 1700 could include a triangular-shaped base 1710 and three triangular-shaped surfaces. Other alternative embodiments could include a polygonal-shaped base 1710, other than a square, and a corresponding number of triangular-shaped surfaces. It should also be understood, that the grid dimension curves 1720-1726, 1732-1738 of the antenna 1700 may be attached to a dielectric substrate material (as shown), or may alternatively be formed without the dielectric substrate.

Figure 24A:
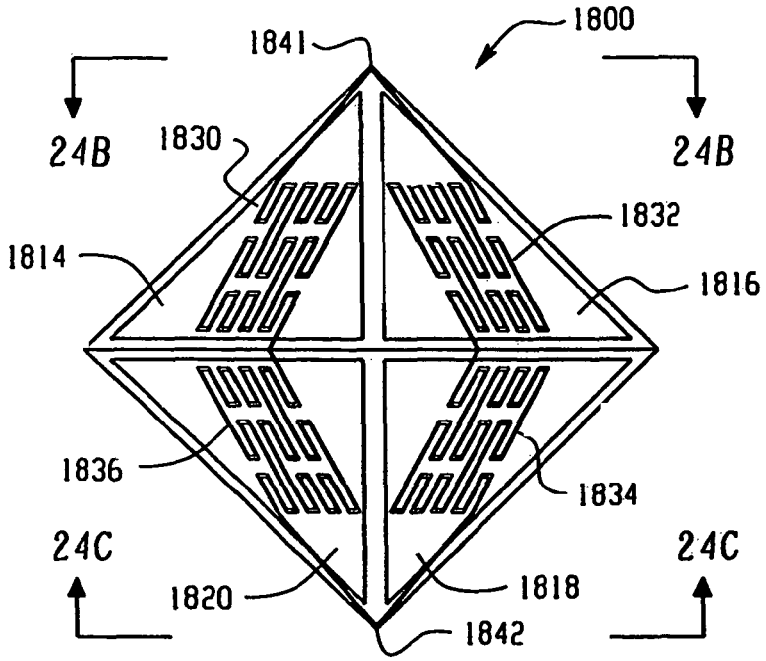
FIGS. 24A-24C shown an exemplary miniature antenna having a rhombic structure.
Figure 24B:
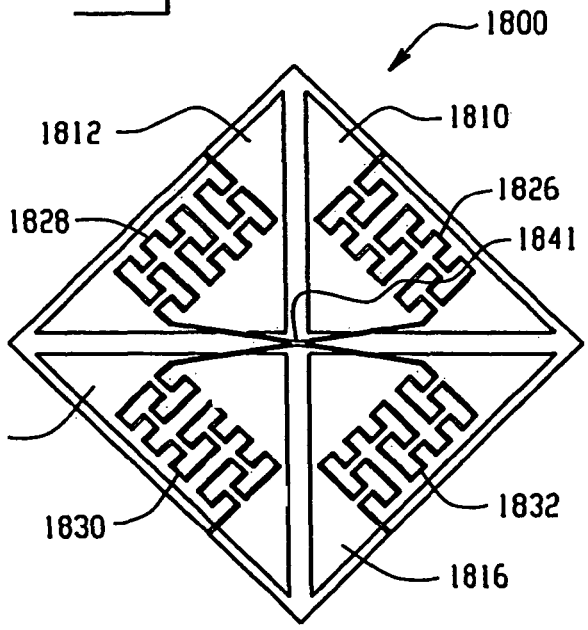
Figure 24C:
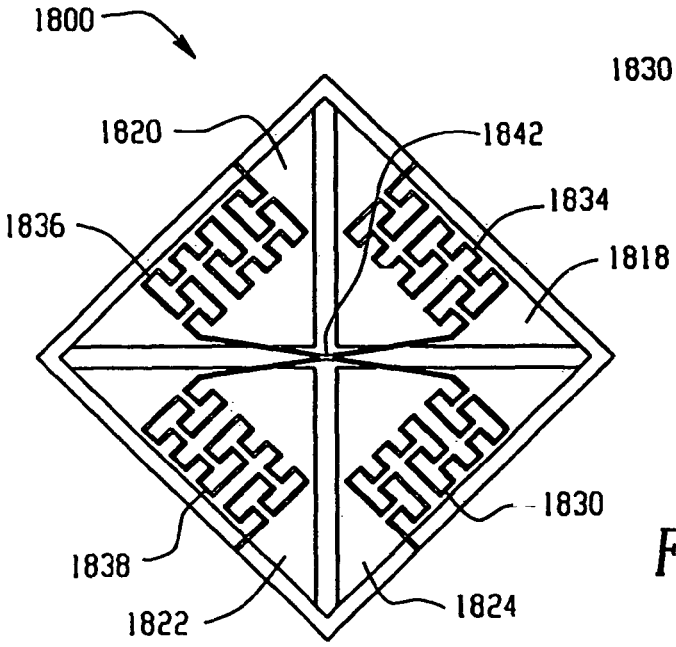

FIGS. 24A-24C show an exemplary miniature antenna 1800 having a rhombic structure. FIG. 24A is a side view of the antenna 1800, and FIGS. 24B and 24C are top and bottom views, respectively. The antenna 1800 includes eight triangular-shaped surfaces 1810-1824. Four of the triangular-shaped surfaces 1810-1816 are coupled together at the edges to form an upper four-sided pyramid (FIG. 24B) with an upward-pointing apex 1841, and the other four triangular-shaped surfaces 1818-1824 are coupled together to form a lower four-sided pyramid (FIG. 24C) with a downward-pointing apex 1842. The edges at the bases of the two four-sided pyramids are coupled together, as shown in FIG. 24A, to form the rhombic antenna structure.

The surfaces 1810-1824 of the antenna 1800 each include a conductor 1826-1840 that defines a grid dimension curve in the plane of the respective surface 1810-1824. The end points of the grid dimension curves 1826-1840 are coupled together to form a conductive path having a feeding point at the downward-pointing apex 1842. More specifically, with reference to FIG. 24C, the four grid dimension curves 1834-1840 on the surfaces 1818-1824 of the lower pyramid are each coupled at one end point to a common feeding point located at the downward-pointing apex 1842. The other end point of each the lower grid dimension curves 1834-1840 is coupled to an end point on one of the grid dimension curves 1826-1832 on the upper pyramid, as shown in FIG. 24A. With reference to FIG. 24B, the other end points of the grid dimension curves 1826-1832 on the upper pyramid are coupled together at a common point located at the upward-pointing apex 1841 of the antenna 1800. Schematically, the antenna 1800 provides four parallel electrical paths between the feeding point 1842 and the common point at the upward-pointing apex 1841.

It should be understood that other rhombic structures having a different number of surfaces could be utilized in other embodiments of the antenna 1800. It should also be understood that the grid dimension curves 1826-1840 of the antenna 1800 may be attached to a dielectric substrate material (as shown), or may alternatively be formed without the dielectric substrate.

Figure 25:
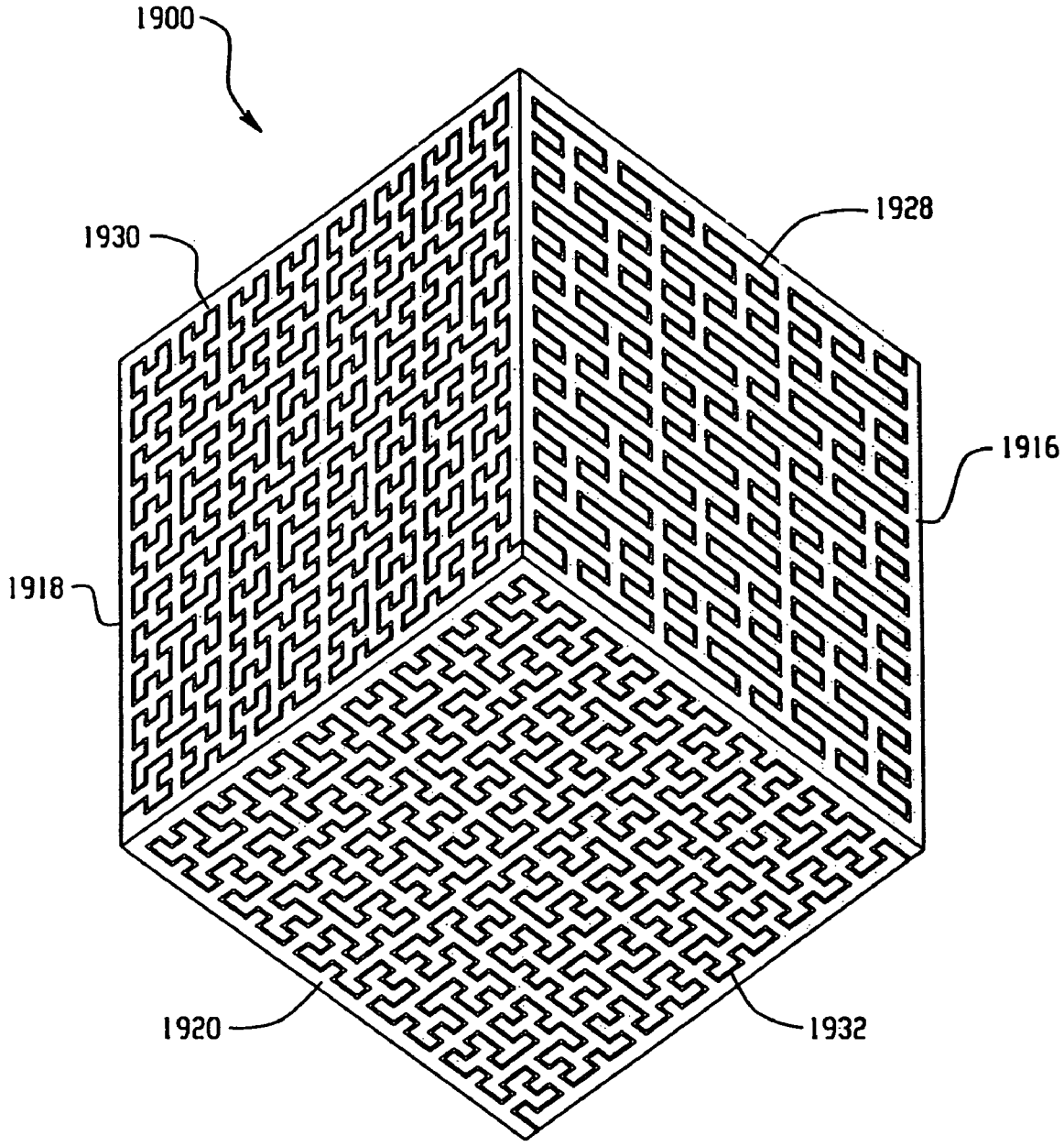
FIGS. 25 and 26 show an exemplary miniature antenna having a polyhedral structure.
Figure 26:
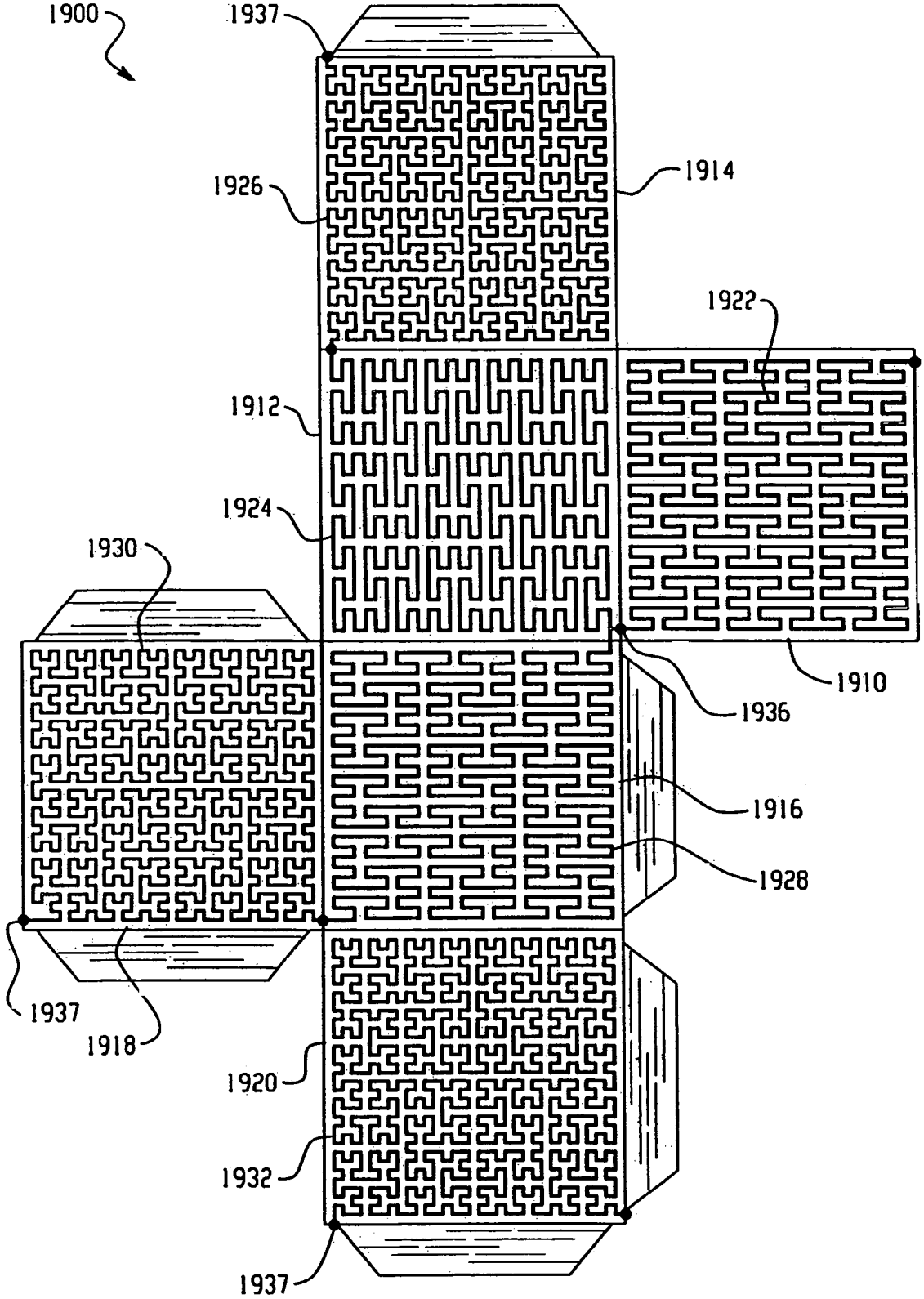

FIGS. 25 and 26 show an exemplary miniature antenna 1900 having a polyhedral structure. FIG. 25 is a three-dimensional view of the miniature polyhedral antenna 1900. The antenna 1900 includes six surfaces 1910-1920 that are coupled together at the edges to form a cube. In other embodiments, however, the antenna 1900 could include a different number of surfaces, forming a polyhedral structure other than a cube. Each surface 1910-1920 of the antenna includes a conductor 1922-1932 that defines a grid dimension curve having two end points. One endpoint 1934 of the six grid dimension curves 1922-1932 is a feeding point for the antenna 1900, and the other endpoints are coupled together as shown in FIG. 26. The grid dimension curves 1922-1932 may be attached to a dielectric substrate material (as shown), or may alternatively be formed without a dielectric substrate, for example, by cutting or molding a conductive material into the shape of the grid dimension curves 1922-1932.

FIG. 26 is a two-dimensional representation of the miniature polyhedral antenna of FIG. 25, illustrating the interconnection between the grid dimension curves 1922-1932 on each surface 1910-1920 of the antenna 1900. The solid black dots shown in FIG. 26 are included to illustrate the points at which the grid dimension curves 1922-1932 connect, and do not form part of the antenna structure 1900. The grid dimension curves 1922-1932 form three parallel electrical paths from a common feeding point 1936 to a common end point 1937. More particularly, a first set of three grid dimension curves 1922, 1924, 1928 are each coupled together at the common feeding point 1936. The other end points of the first set of grid dimension curves 1922, 1924, 1928 are each respectively coupled to one end point of a second set of three grid dimension curves 1932, 1926, 1930, which converge together at the common end point 1937.

In the illustrated embodiment, the first set of three grid dimension curves 1922, 1924, 1928 each define a first type of space-filling curve, called a Hilbert curve, and the second set of three grid dimension curves 1926, 1932, 1930 each define a second type of space-filling curve, called an SZ curve. It should be understood, however, that other embodiments coupled include other types of grid dimension curves.

Figure 27:
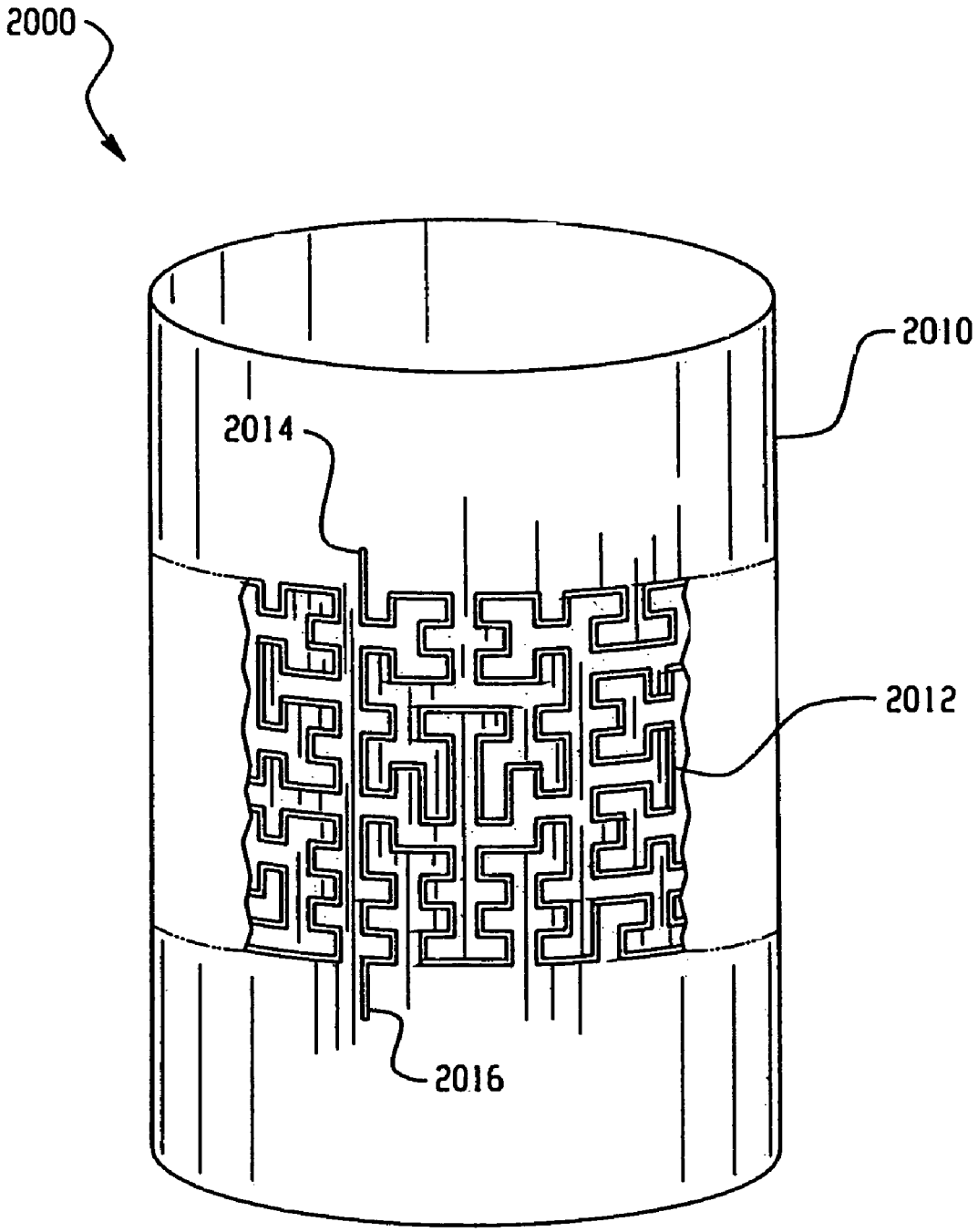
FIG. 27 is a three-dimensional view of an exemplary miniature cylindrical slot antenna.

FIG. 27 is a three-dimensional view of an exemplary miniature cylindrical slot antenna 2000. The antenna 2000 includes a cylindrical conductor 2010 and a grid dimension curve 2012 that is defined by a slot through the surface of the conductor 2010. More particularly, the grid dimension curve 2012 extends continuously from a first end point 2014 to a second end point 2016. The antenna 2000 may, for example, be attached to a transmission medium at a feeding point on the cylindrical conductor 2010 to couple the antenna 2000 to transmitter and/or receiver circuitry. In addition, the length of the grid dimension curve 2012 may be pre-selected to help tune the operational frequency band of the antenna 2000.

Figure 28:
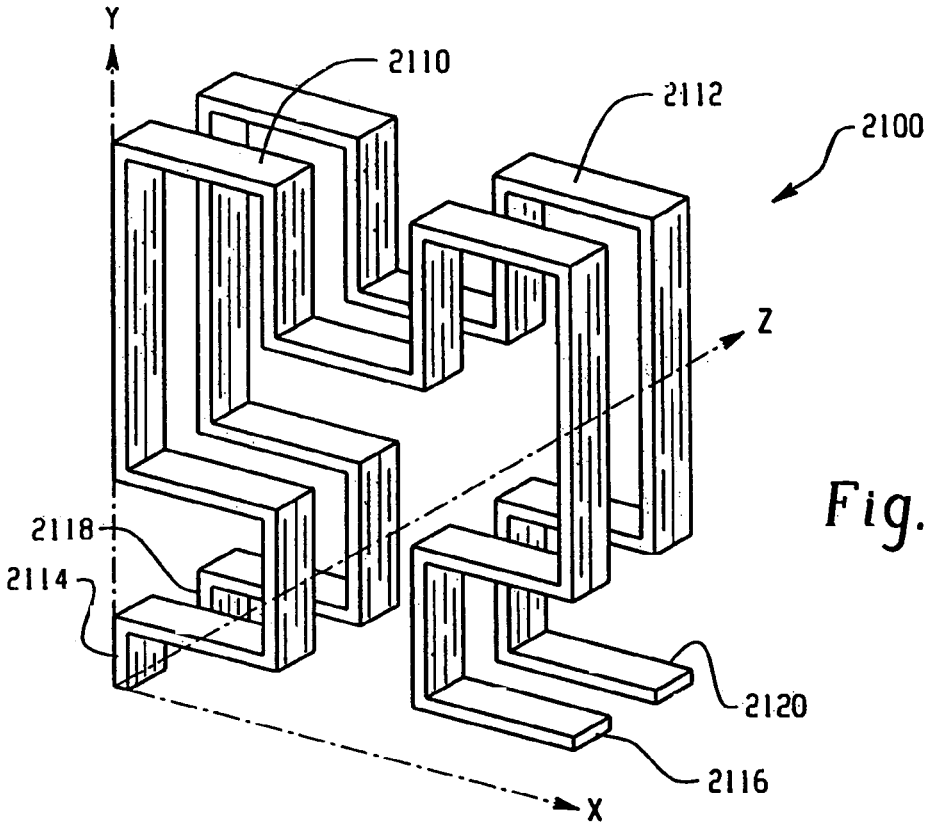
FIG. 28 is a three-dimensional view of an exemplary miniature antenna having an active radiating arm and a side-coupled parasitic radiating arm.

FIG. 28 is a three-dimensional view of an exemplary miniature antenna 2100 having an active radiating arm 2110 and a side-coupled parasitic radiating arm 2112. Also illustrated are x, y, and z axes to help illustrate the orientation of the antenna 2100. Both radiating arms 2110, 2112 are conductors that define grid dimension curves in, or parallel to, the xy plane, and are extruded in the direction of the z axis to define a width. The radiating arms 2110, 2112 may, for example, be visualized as conductive ribbons that are folded at points along their lengths to form three-dimensional representations of a grid dimension curve. More particularly, the active radiating arm 2110 includes a first end point 2114 and extends continuously in a grid dimension curve to a second end point 2116. The parasitic radiating arm 2112 is separated from the active radiating arm 2110 by a pre-defined distance in the direction of the z axis, and extends continuously in a grid dimension curve from a first end point 2118 to a second end point 2120. In addition, the shape of the active radiating arm 2110 is preferably the same or substantially the same as the shape of the parasitic radiating arm 2112, such that an edge of the active radiating arm 2110 is parallel to an edge of the parasitic radiating arm 2112.

Operationally, the antenna 2100 is fed at a point on the active radiating arm 2110 and is grounded at a point on the parasitic radiating arm 2112. The distance between the active and parasitic: radiating arms 2110, 2112 is selected to enable electromagnetic coupling between the two radiating arms 2110, 2112, and may be used to tune impedance, VSWR, bandwidth, power efficiency, and other characteristics of the antenna 2100. The operational characteristics of the antenna 2100, such as the frequency band and power efficiency, may be tuned in part by selecting the length of the two grid dimension curves and the distance between the two radiating arms 2110, 2112. For example, the degree of electromagnetic coupling between the radiating arms 2110, 2112 affects the effective volume of the antenna 2100 and may thus enhance the antenna's bandwidth.

Figure 29:
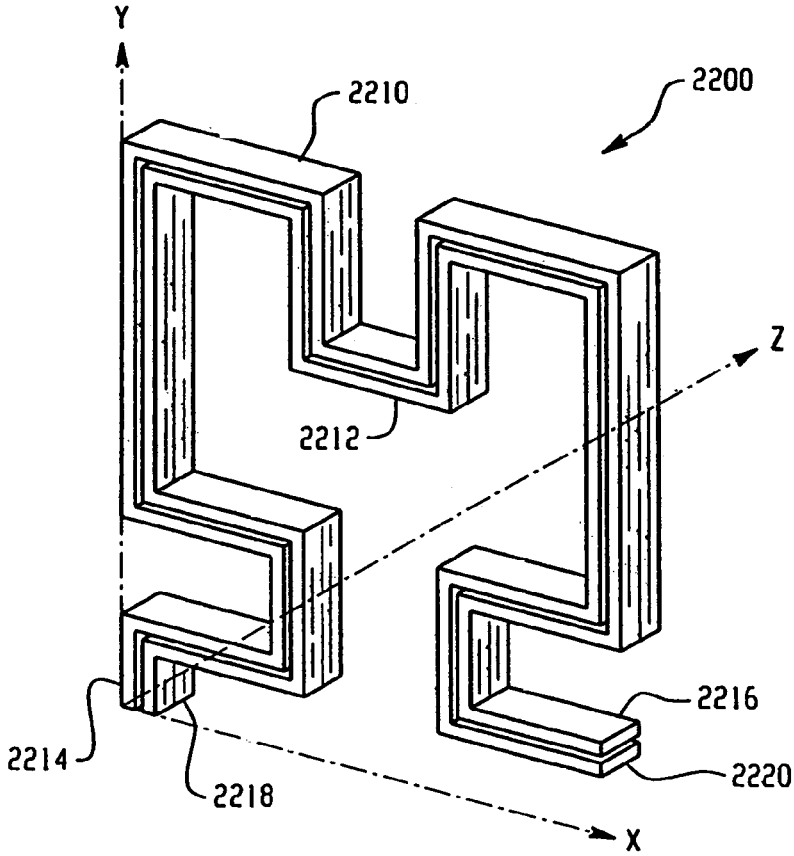
FIG. 29 is a three-dimensional view of an exemplary miniature antenna having an active radiating arm and an inside-coupled parasitic radiating arm.

FIG. 29 is a three-dimensional view of an exemplary miniature antenna 2200 having an active radiating arm 2210 and an inside-coupled parasitic radiating arm 2212. Also illustrated are x, y, and z axes to help illustrate the orientation of the antenna 2200. Both radiating arms 2210, 2212 are ribbon-like conductors that define grid dimension curves in the xy plane, and that are extruded in the direction of the z axis to define a width. More particularly, the active radiating arm 2210 forms a continuous grid dimension curve in the xy plane from a first end point 2214 to a second end point 2216. Similarly, the parasitic radiating arm 2212 forms a continuous grid dimension curve in the xy plane from a first end point 2218 to a second end point 2220, and is separated by a pre-defined distance from an inside surface of the active radiating arm 2212.

Operationally, the antenna 2200 is fed at a point on the active radiating arm 2210 and is grounded at a point on the parasitic radiating arm 2212. Similar to the antenna 2100 described above with reference to FIG. 28, the operational characteristics of this antenna embodiment 2200 may be tuned in part by selecting the length of the grid dimension curves and the distance between the two radiating arms 2210, 2212.

Figure 30:
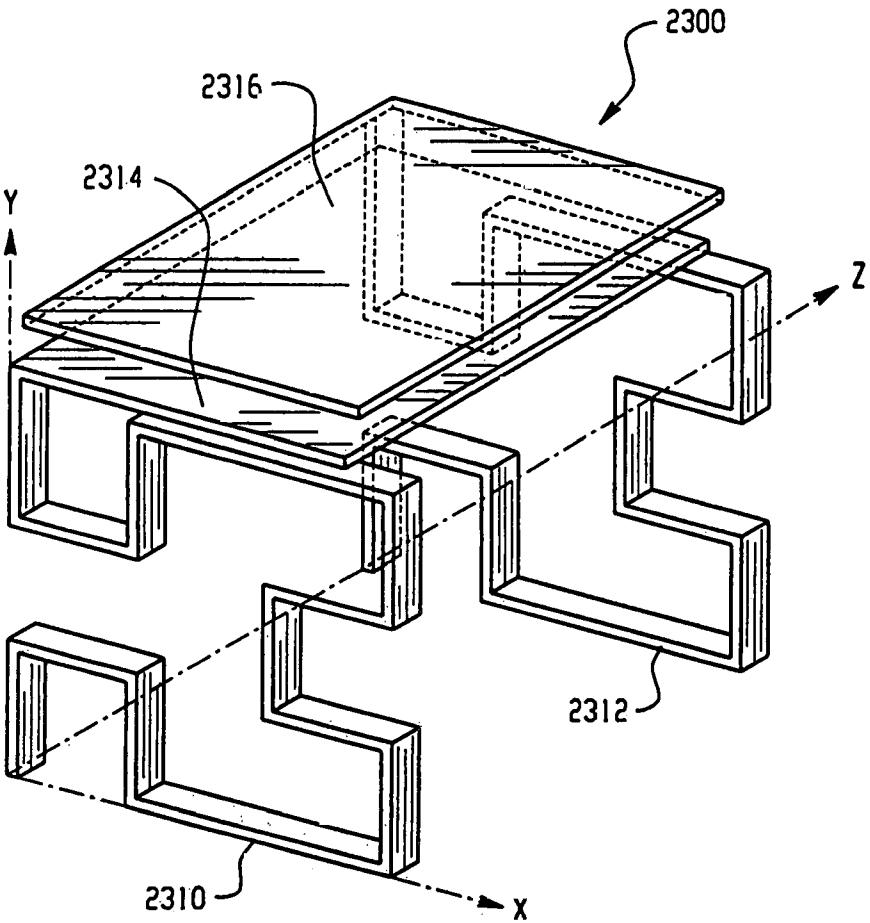
FIG. 30 is a three-dimensional view of an exemplary miniature antenna having active and parasitic radiating arms with electromagnetically coupled top-loading portions.

FIG. 30 is a three-dimensional view of an exemplary miniature antenna 2300 having active 2310 and parasitic 2312 radiating arms with electromagnetically coupled top-loading portions 2314, 2316. Also illustrated are x, y, and z axes to help illustrate the orientation of the antenna 2300. Similar to the antenna structures 2210, 2212 shown in FIG. 28, the active 2310 and parasitic 2312 radiating arms in this embodiment 2300 are ribbon-like conductors that define grid dimension curves in, or parallel to, the xy plane, and that are extruded in the direction of the z axis to define a width. The active and parasitic radiating arms are separated by a pre-defined distance in the direction of the z axis. In addition, the antenna 2300 includes an active top-loading portion 2314 coupled to an end point of the active radiating arm 2310 and a parasitic top-loading portion 2316 coupled to an end point of the parasitic radiating arm 2312. The active and parasitic top-loading portions 2314, 2316 include planar conductors that are aligned parallel with the xz plane, and that are separated by a pre-defined distance in the direction of the y axis.

Operationally, the antenna 2300 is fed at a point on the active radiating arm 2310 and is grounded at a point on the parasitic radiating arm 2312. The distance between the active 2314 and parasitic 2316 top-loading portions is selected to enable electromagnetic coupling between the two top-loading portions 2314, 2316. In addition, the distance between the active and parasitic radiating arms 2310, 2312 may be selected to enable some additional amount of electromagnetic coupling between the active 2310, 2314 and parasitic 2312, 2316 sections of the antenna 2300. As described above, the length of the grid dimension curves 2310, 2312, along with the degree of electromagnetic coupling between the active 2310, 2314 and passive 2312, 2316 sections of the antenna 2300, affect the operational characteristics of the antenna 2300, such as frequency band and power efficiency.

Figure 31:
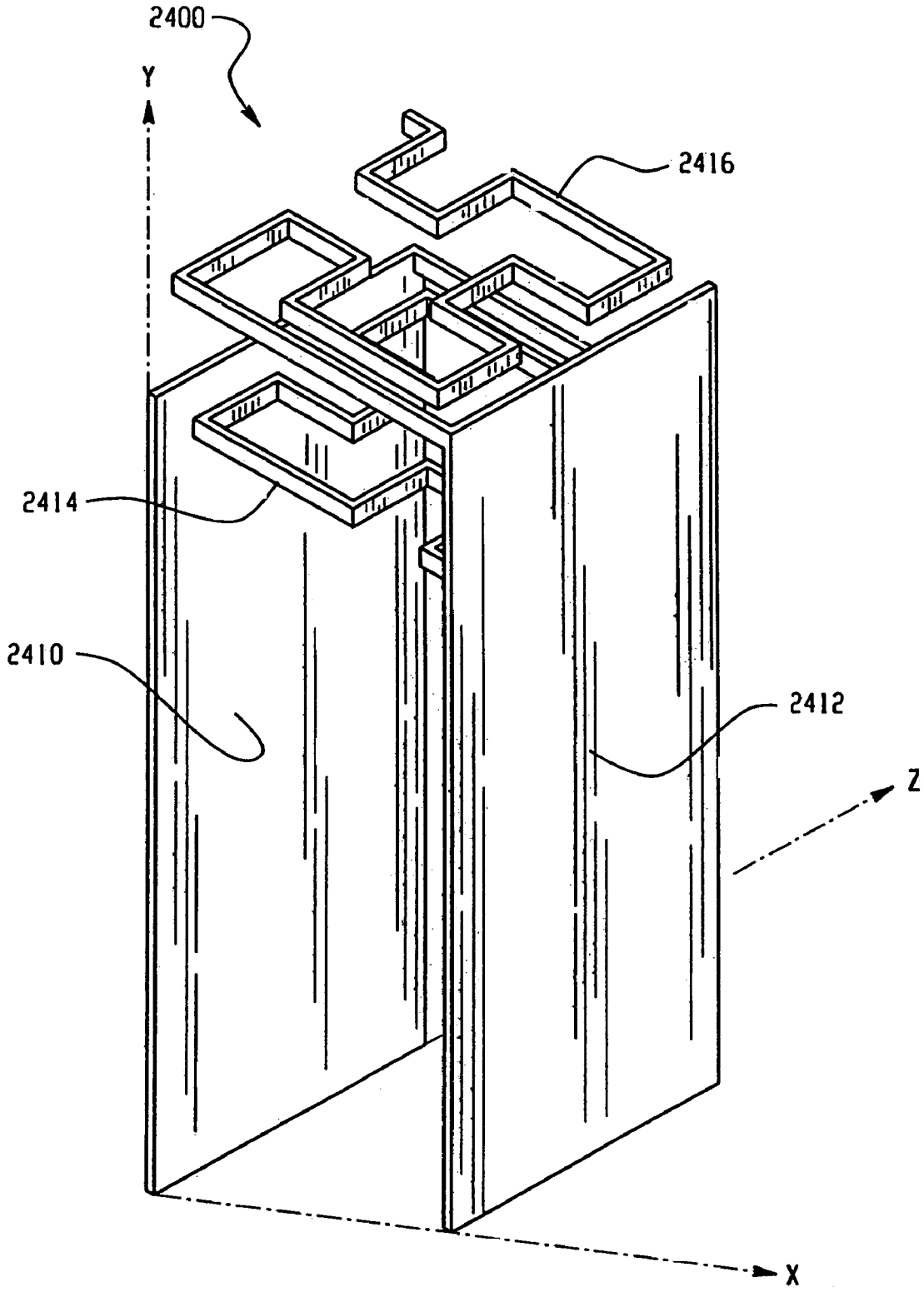
FIG. 31 shows one alternative embodiment of the miniature antenna of FIG. 30.

FIG. 31 shows one alternative embodiment 2400 of the miniature antenna 2300 of FIG. 30. This antenna embodiment 2400 is similar to the antenna 2300 described above with reference to FIG. 30, except that the active 2410 and parasitic 2412 radiating arms in this embodiment 2400 include planar conductors and the active 2414 and parasitic 2416 top-loading portions define grid dimension curves parallel to the xz plane. Similar to the antenna 2300 of FIG. 30, the operational characteristics of this antenna embodiment 2400 are affected in large part by the length of the grid dimension curves 2414, 2416 and the degree of electromagnetic coupling caused by the distance between the top-loading portions 2414, 2416.

Figure 32:
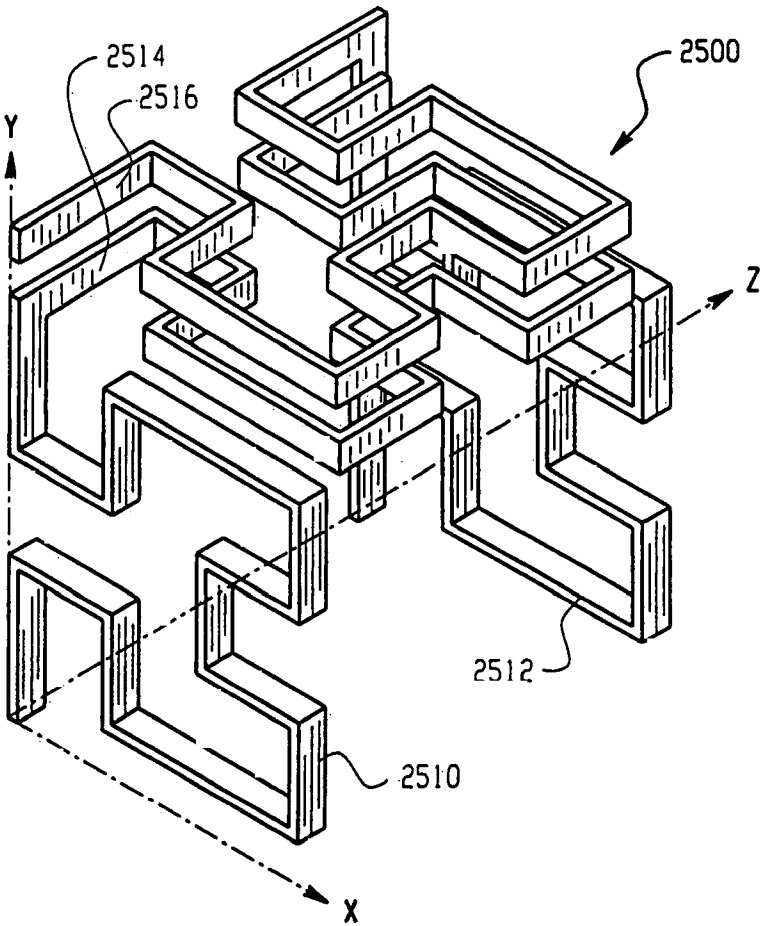
FIG. 32 shows another alternative embodiment of the miniature antenna of FIG. 30.

FIG. 32 shows another alternative embodiment of the miniature antenna of FIG. 30. This antenna embodiment 2500 is similar to the antennas 2300, 2400 described above with reference to FIGS. 30 and 31, except that both the radiating arms 2510, 2512 and the top-loading portions 2514, 2516 in this embodiment 2500 define grid dimension curves. The active 2510 and parasitic 2512 radiating arms define grid dimension curves in, or parallel to, the xy plane, similar to the radiating arms 2310, 2312 shown in FIG. 30. The active 2514 and parasitic 2516 top-loading portions define grid dimension curves parallel to the xz plane similar to the top-loading portions 2414, 2416 shown in FIG. 31. In addition, the operational characteristics of this antenna embodiment 2500 are similarly affected in large part by the distance between the top-loading portions 2514, 2516 and the respective lengths of the grid dimension curves 2510-2516.

Figure 33:
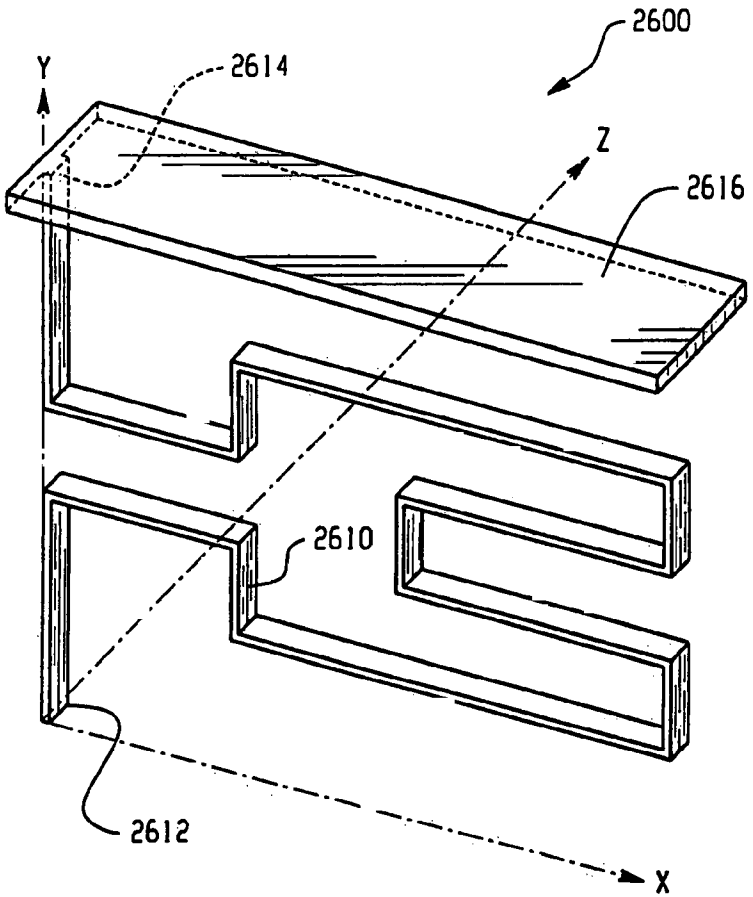
FIG. 33 is a three-dimensional view of an exemplary extruded miniature antenna having an extruded top-loading portion.

FIG. 33 is a three-dimensional view of an exemplary top-loaded miniature antenna 2600. The antenna includes a ribbon-like radiating arm 2610 that defines a grid dimension curve in the xy plane and that is extruded in the direction of the z axis to define a width. More particularly, the radiating arm 2610 extends in the shape of a three-dimensional grid dimension curve from a first edge 2612 to a second edge 2614. In addition, the antenna 2600 includes a top-loading portion 2616 coupled to the second edge 2614 of the radiating arm 2610. The top-loading portion 2616 is a planar conductor that extends away from the second edge 2614 of the radiating arm 2610 in a direction parallel with the x axis, and is extruded in the direction of the z axis to define a width that is greater than the width of the radiating arm 2610. The antenna 2600 is fed at a point on the radiating arm, preferably at or near the first edge 2612, and has an operational frequency band that is defined in large part by the length of the grid dimension curve.

Figure 34:
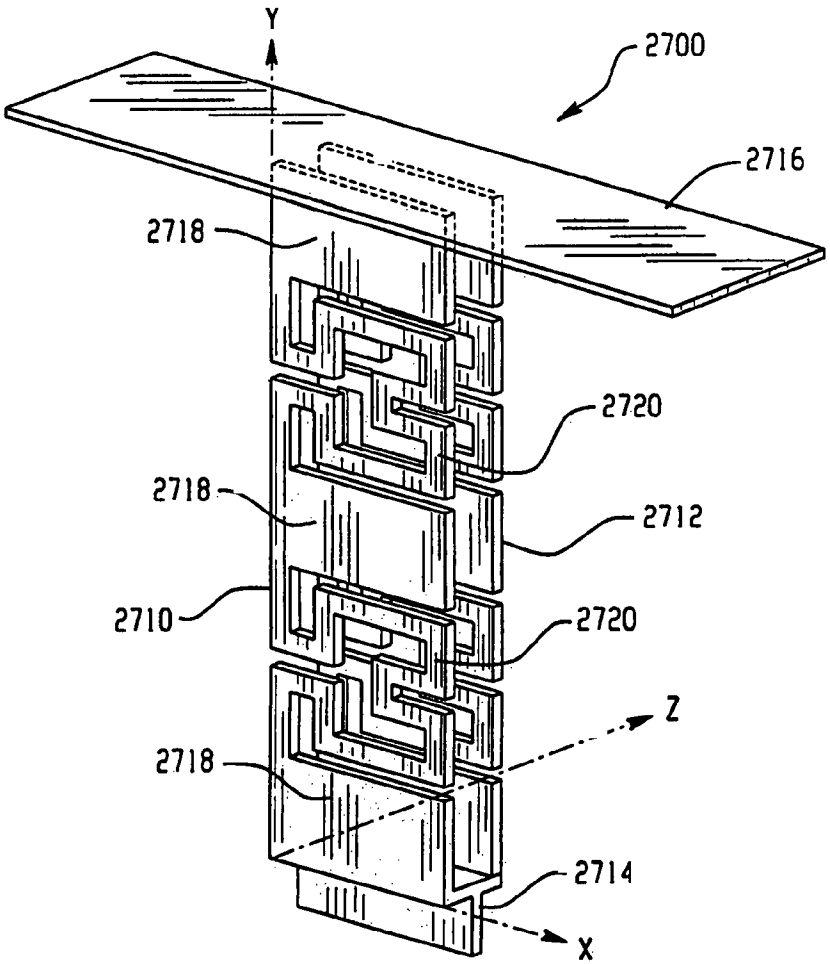
FIG. 34 is a three-dimensional view of an exemplary miniature antenna having two parallel radiating arms with a common top-loading portion.

FIG. 34 is a three-dimensional view of an exemplary miniature antenna having two parallel radiating arms 2710, 2712 with a common feeding portion 2714 and a common top-loading portion 2716. Also illustrated are x, y, and z axes to help illustrate the orientation of the antenna. The parallel radiating arms 2710, 2712 and the common feeding portion 2714 are each planar conductors aligned with, or parallel to, the xy axis, and the common top-loading portion 2716 is a planar conductor aligned parallel to the xz axis. The two radiating arms 2710, 2712 are separated by a pre-defined distance along the z axis, and are each coupled to the common feeding portion 2714 at one end and to the common top-loading portion 2716 at the other end. Schematically, the antenna 2700 includes two parallel electrical paths through the parallel radiating arms 2710, 2712 from the common feeding portion 2714 to the common top-loading portion 2716.

In addition, both of the illustrated parallel radiating arms 2710, 2712 includes three planar conductors 2718 and two winding conductors 2720, with the winding conductors 2720 each defining a grid dimension curve. In other embodiments, however, varying proportions of the radiating arms 2710, 2712 may be made up of one or more winding conductors 2720. In this manner, the effective conductor length of the radiating arms 2710, 2712, and thus the operational frequency band of the antenna 2700, may be altered by changing the proportion of the radiating arms 2710, 2712 that are made up by winding conductors 2720. The operational frequency band of the antenna 2700 may be further adjusted by changing the grid dimension of the winding conductors 2720. In addition, various operational characteristics of the antenna 2700, such as the frequency band and power efficiency, may also be tuned by varying the distance between the radiating arms 2710, 2712.

Figure 35:
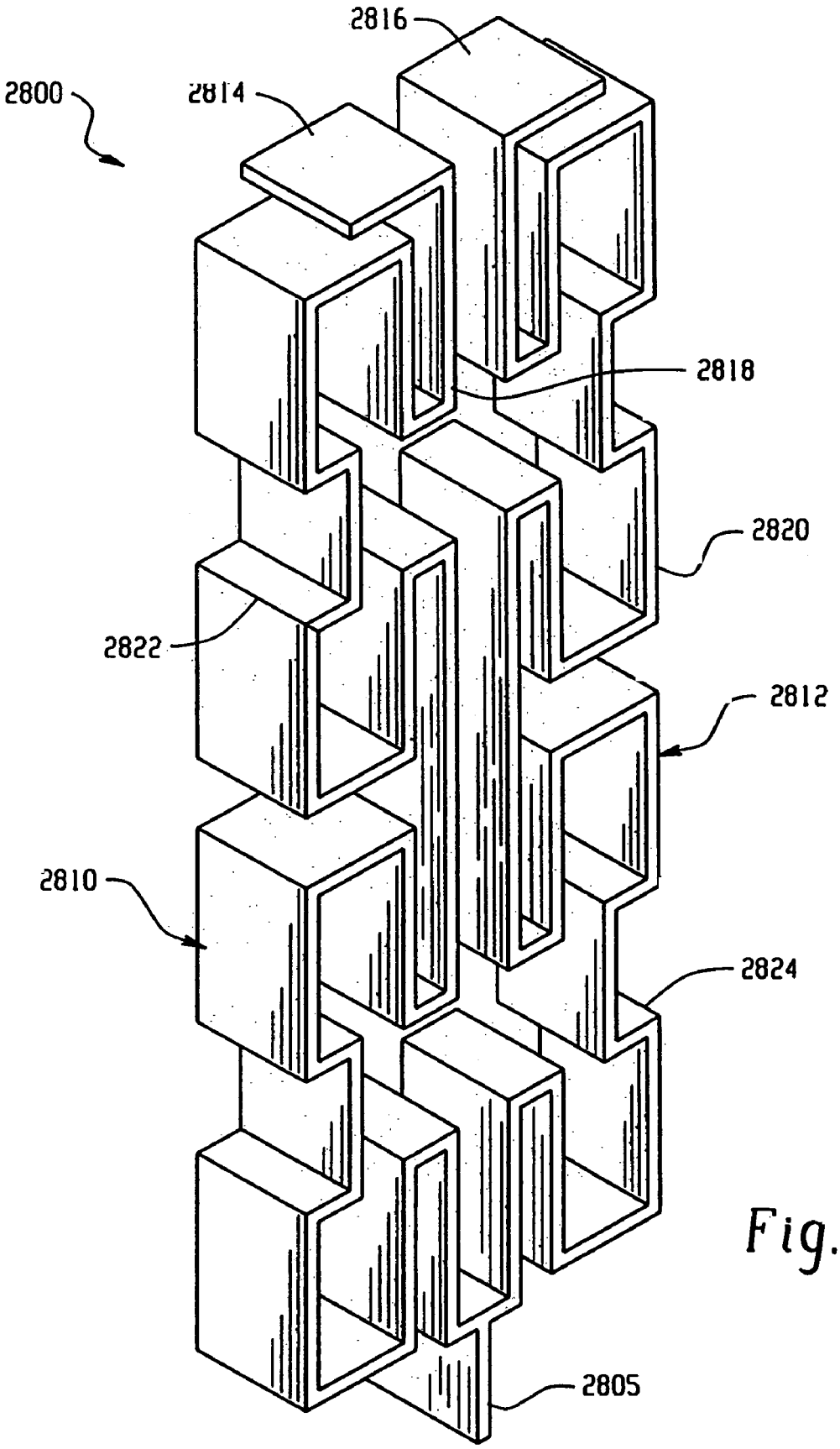
FIG. 35 is a three-dimensional view of an exemplary top-loaded two branch grid dimension curve antenna.

FIG. 35 is a three-dimensional view of an exemplary top-loaded two branch grid dimension curve antenna 2800. The antenna 2800 includes a common feeding portion 2805, two radiating arms 2810, 2812, and two top-loading portions 2814, 2816. The radiating arms 2810, 2812 are ribbon-like conductors that each define a grid dimension curve 2818, 2820 along a common plane. In addition, each radiating arm 2810, 2812 is extruded in a direction perpendicular to the respective grid dimension curve 2818, 2820 to define a width 2822, 2824, thus forming a three-dimensional representation of the grid dimension curve 2818, 2820. More particularly, the radiating arms 2810, 2812 each include a bottom edge that is coupled to the common feeding portion 2805 and extend continuously in the shape of a grid dimension curve 2828, 2820 to a top edge. The top edges of the radiating arms 2810, 2812 are each coupled to one of the top-loading portions 2814, 2816. In addition, the radiating arms 2810, 2812 are separated from each other along their widths 2822, 2824 by a predetermined distance.

In operation, the frequency band of the antenna 2800 is defined in significant part by the respective lengths of the radiating arms 2810, 2812. Thus, the antenna frequency band may be tuned by changing the effective conductor length of the grid dimension curves 2810, 2812. This may be achieved, for example, by either increasing the overall length of the radiating arms 2810, 2812, or increasing the grid dimension of the grid dimension curves 2810, 2812. In addition, a larger bandwidth may be achieved by varying the lengths of the grid dimension curves 2818, 2820 from one radiating arm to another, such that the radiating arms 2810, 2812 resonate at slightly different frequencies. Similarly, a multi-band antenna may be achieved by varying the lengths of the radiating arms 2810, 2812 by a greater amount, such that the respective resonant frequencies do not result in overlapping frequency bands. It should be understood, however, that the antenna's operational characteristics, such as frequency band and power efficiency, may be altered by varying other physical characteristics of the antenna 2800. For example, the impedance of the antenna may 2800 be affected by varying the distance between the two radiating arms 2810, 2812.

Figure 36:
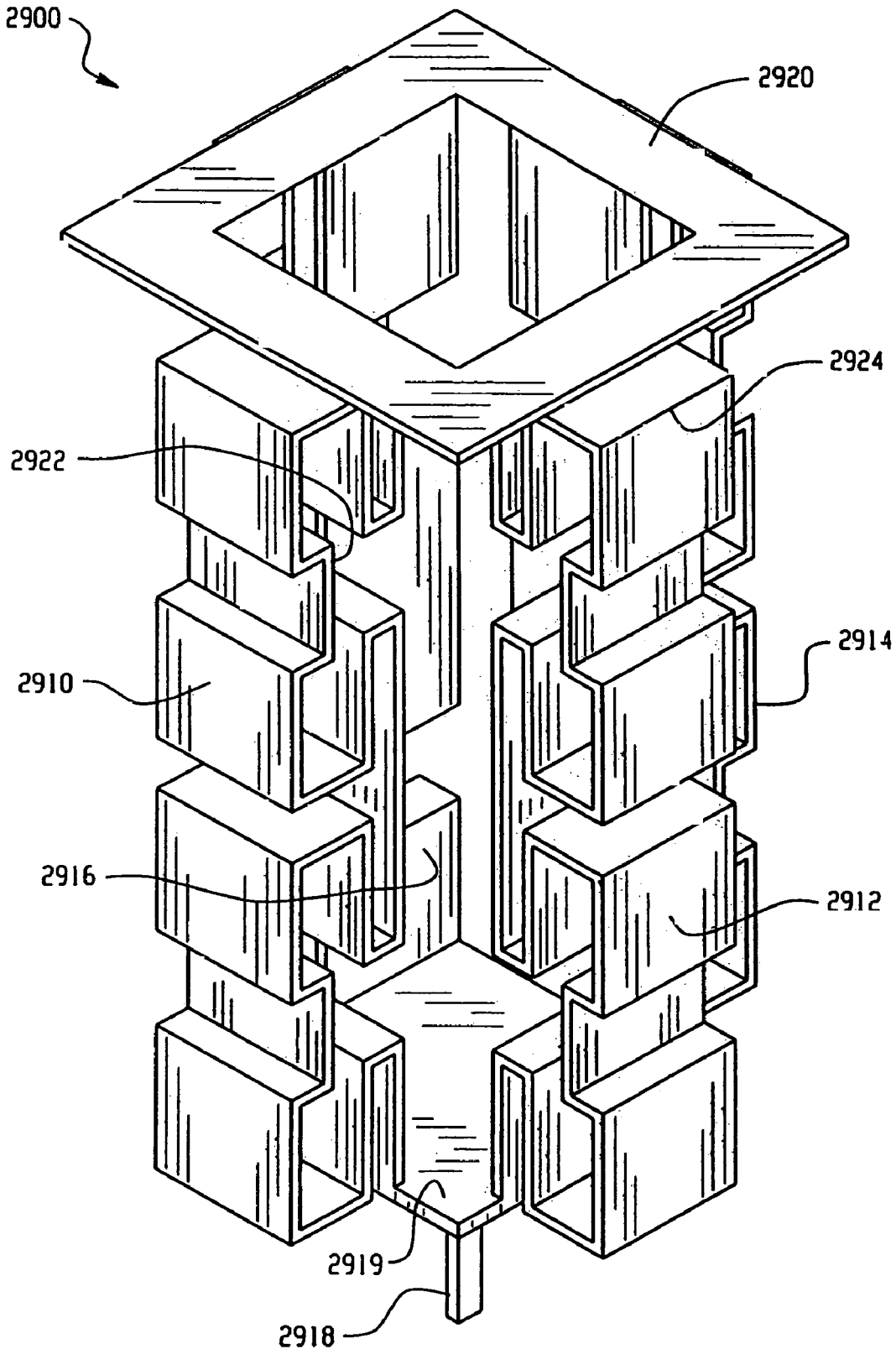
FIG. 36 is a three-dimensional view of an exemplary top-loaded four branch grid dimension curve antenna.

FIG. 36 is a three-dimensional view of an exemplary top-loaded four branch grid dimension curve antenna 2900. The antenna 2900 includes four radiating arms 2910-2916, a common feeding portion 2918, 2919, and a common top-loading portion 2920. Each radiating arm 2910-2916 is a ribbon-like conductor that defines a planar grid dimension curve 2922 along an edge of the conductor 2910-2916, and is extruded in a direction perpendicular to the plane of the grid dimension curve 2922 to define a width 2924 of the conductor 2910-2916. In this manner, each radiating arm 2910-2916 forms a three-dimensional representation of a grid dimension curve. More particularly, the radiating arms 2910-2916 each include a bottom edge that is coupled to the common feeding portion 2918, 2919 and extend continuously in the shape of a grid dimension curve 2922 to a top edge coupled to the common top-loading portion 2920. The common feeding portion includes a vertical section 1918 to couple the antenna 2900 to a transmission medium and a horizontal section 2929 coupled to the four radiating arms 2910-2916.

The four radiating arms 2910-2916 lie in perpendicular planes along the edges of a rectangular array. Thus, the grid dimension curve 2922 in any radiating arm 2910 lies in the same plane as the grid dimension curve of one opposite radiating arm 2914 in the rectangular array, and lies in a perpendicular plane with two adjacent radiating arms 2912, 2916 in the rectangular array. The conductor width 2924 of any radiating arm 2910 lies in a parallel plane with the conductor width of one opposite radiating arm 2914, and lies in perpendicular planes with the conductor widths of two adjacent radiating arms 2912, 2916. In addition, each radiating arm 2910 is separated by a first pre-defined distance from the opposite radiating arm 2914 in the rectangular array and by a second pre-defined distance from the two adjacent radiating arms 2912, 2916 in the rectangular array.

In operation, the frequency band of the antenna 2900 is defined in significant part by the respective lengths of the radiating arms 2910-2916. Thus, the antenna frequency band may be tuned by changing the effective conductor length of the grid dimension curves 2922 of the four radiating arms 2910-2916. This may be achieved, for example, by either increasing the overall length of the radiating arms 2910-2916 or increasing the grid dimension of the grid dimension curves 2922. In addition, the antenna characteristics, such as frequency band and power efficiency, may also be affected by varying the first and second pre-defined distances between the four radiating arms 2910-2916.

It should be understood that other embodiments of the miniature antenna 2900 shown in FIG. 36 may include a different number of radiating arms that extend radially from a common feeding point. As the number of radiating arms in the antenna 2900 is increased, the antenna structure tends to a revolution-symmetric structure having a radial cross-section that defines a grid dimension curve.

This written description uses examples to disclose the invention, including the best mode, and also to enable a person skilled in the art to make and use the invention. The patentable scope of the invention is defined by the claims, and may include other examples that occur to those skilled in the art. For example, each of the miniature monopole antenna structures described above could be mirrored to form a miniature dipole antenna. In another embodiment, a plurality of miniature antennas may be grouped to radiate together by means of a power splitting/combining network. Such a group of miniature antennas may, for example, be used as a directional array by separating the antennas within the group by a distance that is comparable to the operating wavelength, or may be used as a broadband antenna by spacing the antennas at smaller intervals. Embodiments of the miniature antenna may also be used interchangeably as either a transmitting antenna or a receiving antenna. Some possible applications for a miniature antenna include, for example, a radio or cellular antenna within an automobile, a communications antenna onboard a ship, an antenna within a cellular telephone or other wireless communications device, a high-power broadcast antenna, or other applications in which a small-dimensioned antenna may be desirable.

What is claimed is:

1. A miniature antenna comprising:

a radiating element;

a conducting ground plane acting in cooperation with the radiating element;

a common feed point;

wherein the radiating element comprises:

a plurality of radiating arms extending away from the conducting ground plane; and a top-loading portion;

wherein at least one of the plurality of radiating arms comprises a top edge connected to the top-loading portion;

wherein the top-loading portion is arranged substantially perpendicularly to the plurality of radiating arms;

wherein the common feed point is connected to the plurality of radiating arms;

wherein at least two of the plurality of radiating arms are separated by a pre-defined distance; and wherein the physical dimensions of the radiating element are smaller than one-fifteenth of a longest free-space operating wavelength of the miniature antenna.

2. The miniature antenna of claim 1, wherein each of the plurality of radiating arms defines a grid-dimension curve parallel to a plane.

3. The miniature antenna of claim 2, wherein:

the grid-dimension curve comprises a plurality of segments;

each of the plurality of segments is shorter than a tenth of the longest free-space operating wavelength of the miniature antenna.

4. The miniature antenna of claim 3, wherein the plurality of segments comprises at least ten segments.

5. The miniature antenna of claim 2, wherein the top-loading portion defines a second grid-dimension curve parallel to a second plane.

6. The miniature antenna of claim 5, wherein the top-loading portion is formed by a process comprising extrusion in a direction perpendicular to the second plane.

7. The miniature antenna of claim 2, wherein the pre-defined distance is measured in a direction perpendicular to the plane.

8. The miniature antenna of claim 1, wherein the top-loading portion defines a grid-dimension curve parallel to a plane.

9. The miniature antenna of claim 8, wherein the pre-defined distance is measured in a direction parallel to the plane.

10. The miniature antenna of claim 2, wherein each of the plurality of radiating arms is formed by a process comprising extrusion in a direction perpendicular to the plane.

11. The miniature antenna of claim 2, wherein the pre-defined distance is measured in a direction parallel to the plane.

12. The miniature antenna of claim 1, wherein at least two of the plurality of radiating arms are identical.

13. A miniature antenna comprising:

a radiating arm defining a grid-dimension curve in a plane and comprising a top edge and a bottom edge;

a conducting ground plane acting in cooperation with the radiating arm;

a feed point connected to the bottom edge;

a top-loading portion connected to the top edge and extending from the top edge in a direction substantially perpendicular to the plane; and wherein the physical dimensions of the radiating arm are smaller than one-fifteenth of a longest free-space operating wavelength of the miniature antenna.

14. The miniature antenna of claim 13, wherein:

the grid-dimension curve comprises a plurality of segments;

each of the plurality of segments is shorter than a tenth of the longest free-space operating wavelength of the miniature antenna.

15. The miniature antenna of claim 14, wherein the plurality of segments comprise at least ten segments.

16. The miniature antenna of claim 13, wherein the radiating arm is formed by a process comprising extrusion in a direction perpendicular to the plane.

17. The miniature antenna of claim 13, wherein the radiating arm is a ribbon-like conductor.

18. A miniature antenna comprising:

a radiating element;

a conducting ground plane acting in cooperation with the radiating element;

a common feed point;

wherein the radiating element comprises:

a first radiating arm comprising a first end and a second end and defining a first grid-dimension curve parallel to a first plane;

a second radiating arm comprising a first end and a second end and defining a second grid-dimension curve parallel to the first plane;

a feed portion connecting the common feed point to the first-radiating-arm first end and to the second-radiating-arm first end;

a top-loading portion connected to at least one of the first-radiating-arm second end and the second-radiating-arm second end;

wherein the first radiating arm and the second radiating arm are separated by a pre-defined distance; and wherein the physical dimensions of the radiating element are smaller than one-fifteenth of a longest free-space operating wavelength of the miniature antenna.

19. The miniature antenna of claim 18, wherein:

the first grid-dimension curve comprises a first plurality of segments;

the second grid-dimension curve comprises a second plurality of segments; and each of the first plurality of segments and the second plurality of segments is shorter than a tenth of the longest free-space operating wavelength of the miniature antenna.

20. The miniature antenna of claim 19, wherein at least one of the first plurality of segments and the second plurality of segments comprises at least ten segments.

21. The miniature antenna of claim 18, wherein the first grid-dimension curve and the second grid-dimension curve are identical.

22. The miniature antenna of claim 18, wherein the top-loading portion is substantially planar and is perpendicular to the first plane.

23. The miniature antenna of claim 18, wherein a conductor width of the first radiating arm and a conductor width of the second radiating arm lie in respective parallel planes.

24. The miniature antenna of claim 18, comprising a revolution-symmetric structure having a radial cross-section that defines a grid-dimension curve.

25. The miniature antenna of claim 18, comprising:

a third radiating arm comprising a first end and a second end and defining a third grid-dimension curve perpendicular to the first plane; and wherein the feed portion connects the common feed point to the third-radiating-arm first end.

26. The miniature antenna of claim 25, wherein the top-loading portion is connected to the third-radiating-arm second end.

27. The miniature antenna of claim 25, comprising:

a fourth radiating arm comprising a first end and a second end and defining a fourth grid-dimension curve parallel to the first plane; and wherein the feed portion connects the common feed point to the fourth-radiating-arm first end.

28. The miniature antenna of claim 27, wherein:

each of the third grid-dimension curve and the fourth grid-dimension curve comprises a plurality of segments; and each of the plurality of segments is shorter than a tenth of the longest free-space operating wavelength of the miniature antenna.

29. The miniature antenna of claim 28, wherein the plurality of segments comprises at least ten segments.

30. The miniature antenna of claim 27, wherein the top-loading portion is connected to the fourth-radiating-arm second end.

31. The miniature antenna of claim 30, comprising:

a third radiating arm comprising a first end and a second end and defining a third grid-dimension curve perpendicular to the first plane;

a fourth radiating arm comprising a first end and a second end and defining a fourth grid-dimension curve perpendicular to the first plane;

wherein the third radiating arm and the fourth radiating arm are separated by a pre-defined distance; and wherein the feed portion connects the common feed point to the third-radiating-arm first end and the fourth-radiating-arm first end.

32. The miniature antenna of claim 31, wherein a conductor width of the third radiating arm and a conductor width of the fourth radiating arm lie in respective parallel planes.

33. The miniature antenna of claim 31, wherein at least two of the first grid-dimension curve, the second grid-dimension curve, the third grid-dimension curve, and the fourth grid-dimension curve are identical.

34. The miniature antenna of claim 33, wherein the top-loading portion is connected to at least one of the third-radiating-arm second end and the fourth-radiating-arm second end.

35. The miniature antenna of claim 18, wherein the first radiating arm and the second radiating arm are formed by a process comprising extrusion in a direction perpendicular to the first plane.

36. The miniature antenna of claim 31, wherein the third radiating arm and the fourth radiating arm are formed by a process comprising extrusion in a direction parallel to the first plane.

37. The miniature antenna of claim 31, wherein each of the first radiating arm, the second radiating arm, the third radiating arm, and the fourth radiating arm is formed by a process comprising extrusion in a direction perpendicular to a plane of a corresponding grid-dimension curve.

38. The miniature antenna of claim 18, wherein at least one of the first radiating arm and the second radiating arm is a ribbon-like conductor.

39. The miniature antenna of claim 31, wherein at least one of the third radiating arm and the fourth radiating arm is a ribbon-like conductor.

* * * * *